US009165497B2

(12) United States Patent
Asano et al.

(10) Patent No.: US 9,165,497 B2
(45) Date of Patent: Oct. 20, 2015

(54) DISPLAY DEVICE, INTEGRATED CIRCUIT, AND CONTROL METHOD

(71) Applicant: Sony Corporation, Tokyo (JP)

(72) Inventors: Mitsuyasu Asano, Tokyo (JP); Yasuo Inoue, Tokyo (JP)

(73) Assignee: JOLED INC., Tokyo (JP)

( * ) Notice: Subject to any disclaimer, the term of this patent is extended or adjusted under 35 U.S.C. 154(b) by 134 days.

(21) Appl. No.: 13/765,740

(22) Filed: Feb. 13, 2013

(65) Prior Publication Data

US 2013/0249970 A1 Sep. 26, 2013

(30) Foreign Application Priority Data

Mar. 23, 2012 (JP) ..... 2012-067034

(51) Int. Cl.
*G09G 3/22* (2006.01)

(52) U.S. Cl.
CPC ..... *G09G 3/22* (2013.01); *G09G 2320/0252* (2013.01); *G09G 2320/0626* (2013.01); *G09G 2340/16* (2013.01); *G09G 2360/16* (2013.01)

(58) Field of Classification Search
CPC ..... G09G 2320/0233; G09G 2320/0271; G09G 2320/0276; G09G 2320/0626; G09G 2320/0653
USPC ..... 345/211, 611, 617, 690, 691, 87, 89; 348/229.1, 441, 625, 631, 678, 687, 348/688, 790; 382/274; 455/518, 566
See application file for complete search history.

(56) References Cited

U.S. PATENT DOCUMENTS

| | | | | |
|---|---|---|---|---|
| 2006/0071927 | A1* | 4/2006 | Chang et al. | 345/211 |
| 2009/0207193 | A1* | 8/2009 | Isobe et al. | 345/690 |
| 2010/0110300 | A1* | 5/2010 | Ueno et al. | 348/625 |

FOREIGN PATENT DOCUMENTS

WO WO 2008/143208 11/2008

* cited by examiner

*Primary Examiner* — Dwayne Bost
*Assistant Examiner* — Sepehr Azari
(74) *Attorney, Agent, or Firm* — Finnegan, Henderson, Farabow, Garrett & Dunner, LLP

(57) ABSTRACT

There is provided a display device including a temporal direction control unit that causes a gain used to control a video signal to respond to an input video signal at high speed when the input video signal sharply increases, and causes the gain to respond to the input video signal at low speed when the input video signal gently increases.

10 Claims, 16 Drawing Sheets

WHEN CONTROL OF CAUSING RESPONSE AT HIGH SPEED IS PERFORMED

WHEN CONTROL OF CAUSING RESPONSE AT LOW SPEED IS PERFORMED

LINEAR CONVERSION CHARACTERISTICS

γ CONVERSION CHARACTERISTICS

ABL CONTROL WHEN TELOP APPEARS OR DISAPPEARS

GAIN CHANGE CAUSED DUE TO APPEARANCE OR DISAPPEARANCE OF TELOP

FLOW OF PROCESS PERFORMED BY ABL CONTROL UNIT 100

FLOW OF PROCESS PERFORMED BY TEMPORAL DIRECTION CONTROL UNIT 112

FLOW OF PROCESS PERFORMED BY CONTROL VALUE SELECTION UNIT 110

MODIFICATION EXAMPLE #1

MODIFICATION EXAMPLE #2

MODIFICATION EXAMPLE #3

MODIFICATION EXAMPLE #4

DISPLAY DEVICE, INTEGRATED CIRCUIT, AND CONTROL METHOD

BACKGROUND

The present disclosure relates to a display device, an integrated circuit, and a control method.

A self luminous type display device displays an image by causing a light-emitting element to emit light with luminance in accordance with an input current value. When an image signal or a video signal with a signal intensity equal to or greater than a given value is input, an overcurrent may flow in the light-emitting element of the display device.

Accordingly, when the image signal or the video signal with the signal intensity equal to or greater than the given value is input, auto-brightness limiter (ABL) control of limiting luminance is performed by performing gain control so that the overcurrent does not flow in the light-emitting element. For example, PCT International Patent Application Publication No. WO2008/143208 discloses an ABL control method of performing feed-forward control so that an average current value of an image signal or a video signal input to a display unit does not exceed a given threshold value.

SUMMARY

In a technology disclosed in PCT International Patent Application Publication No. WO2008/143208, a speed at which a gain responds to an input signal is not considered in the ABL control.

For this reason, when an increase and a decrease in the average current value of the input signal are repeated, an increase and a decrease in the gain are repeated with the change in the average current value. As a result, since an increase or a decrease in the luminance of an image displayed on the display unit is repeated, image quality may deteriorate.

It is desirable to provide a novel and improved display device, a novel and improved integrated circuit, and a novel and improved control method capable of performing ABL control of automatically adjusting a speed at which a gain is caused to respond to an input signal.

According to an embodiment of the present disclosure, there is provided a display device including a temporal direction control unit that causes a gain used to control a video signal to respond to an input video signal at high speed when the input video signal sharply increases, and causes the gain to respond to the input video signal at low speed when the input video signal gently increases.

Further, according to an embodiment of the present disclosure, there is provided an integrated circuit having a temporal direction control function of causing a gain used to control a video signal to respond to an input video signal at high speed when the input video signal sharply increases, and causes the gain to respond to the input video signal at low speed when the input video signal gently increases.

Further, according to an embodiment of the present disclosure, there is provided a control method including causing a gain used to control a video signal to respond to an input video signal at high speed when the input video signal sharply increases, and causes the gain to respond to the input video signal at low speed when the input video signal gently increases.

According to the embodiments of the present disclosure described above, it is possible to provide the novel and improved display device, the novel and improved integrated circuit, and the novel and improved control method capable of performing the ABL control of automatically adjusting a speed at which a gain is caused to respond to an input signal.

DETAILED DESCRIPTION OF THE EMBODIMENTS

Figure 1:
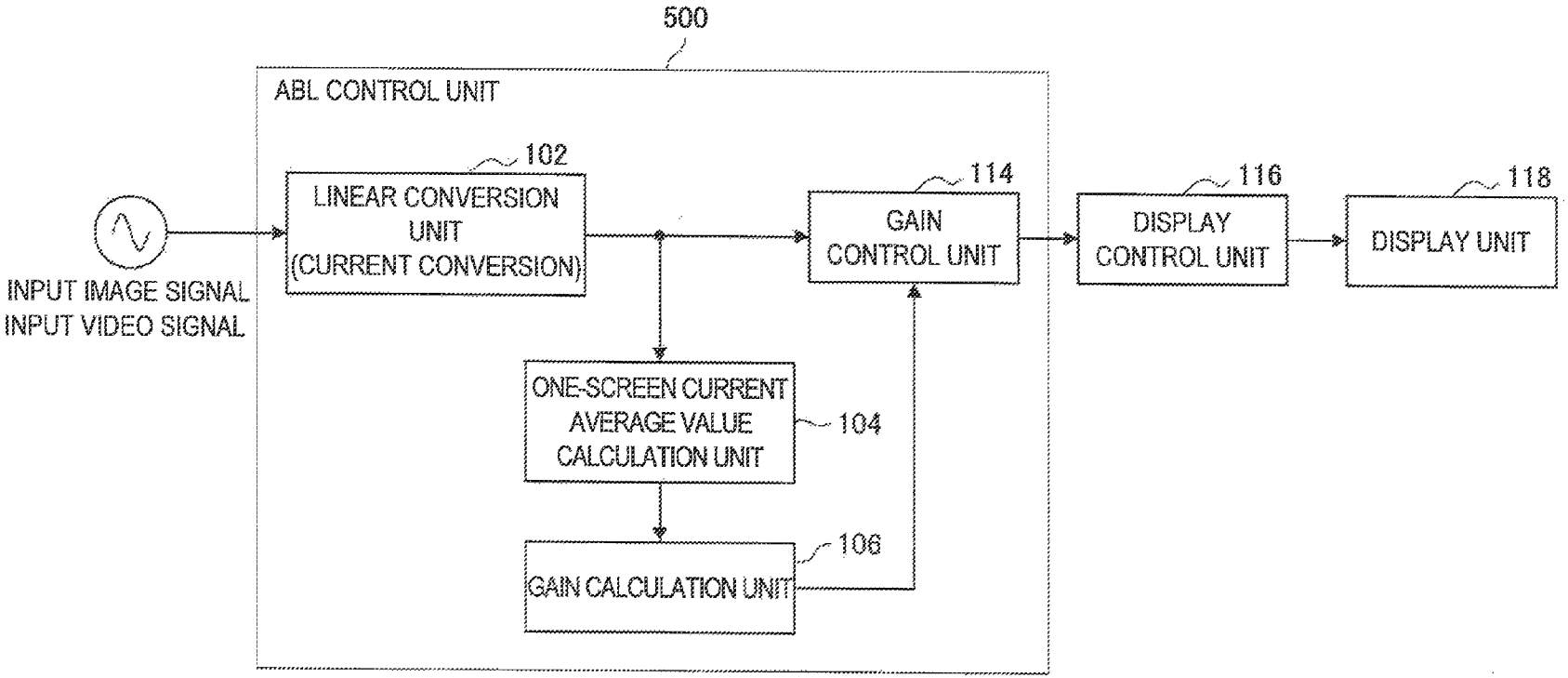
FIG. 1 is a diagram illustrating ABL control in which temporal direction control is not performed.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

The description will be made in the following order.

1. Introduction 1-1. ABL Control in Which Temporal Direction Control Is Not Performed (FIG. 1)

Figure 4:
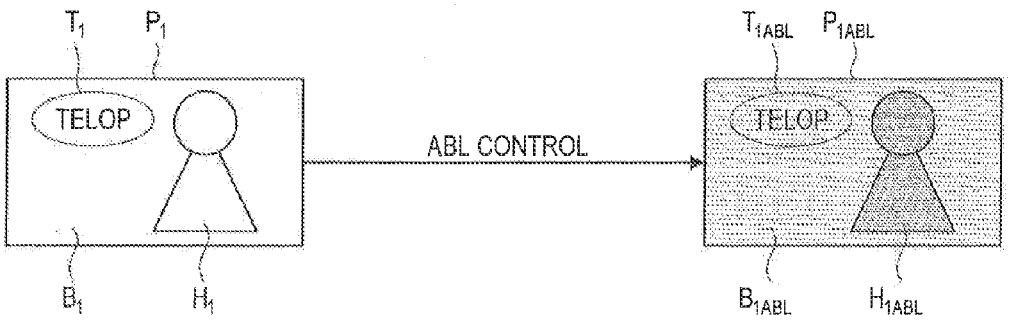
FIG. 4 is a diagram illustrating the ABL control when a telop appears or disappears.

1-2. Example of ABL Control When Telop Appears or Disappears (FIG. 4)

Figure 5:
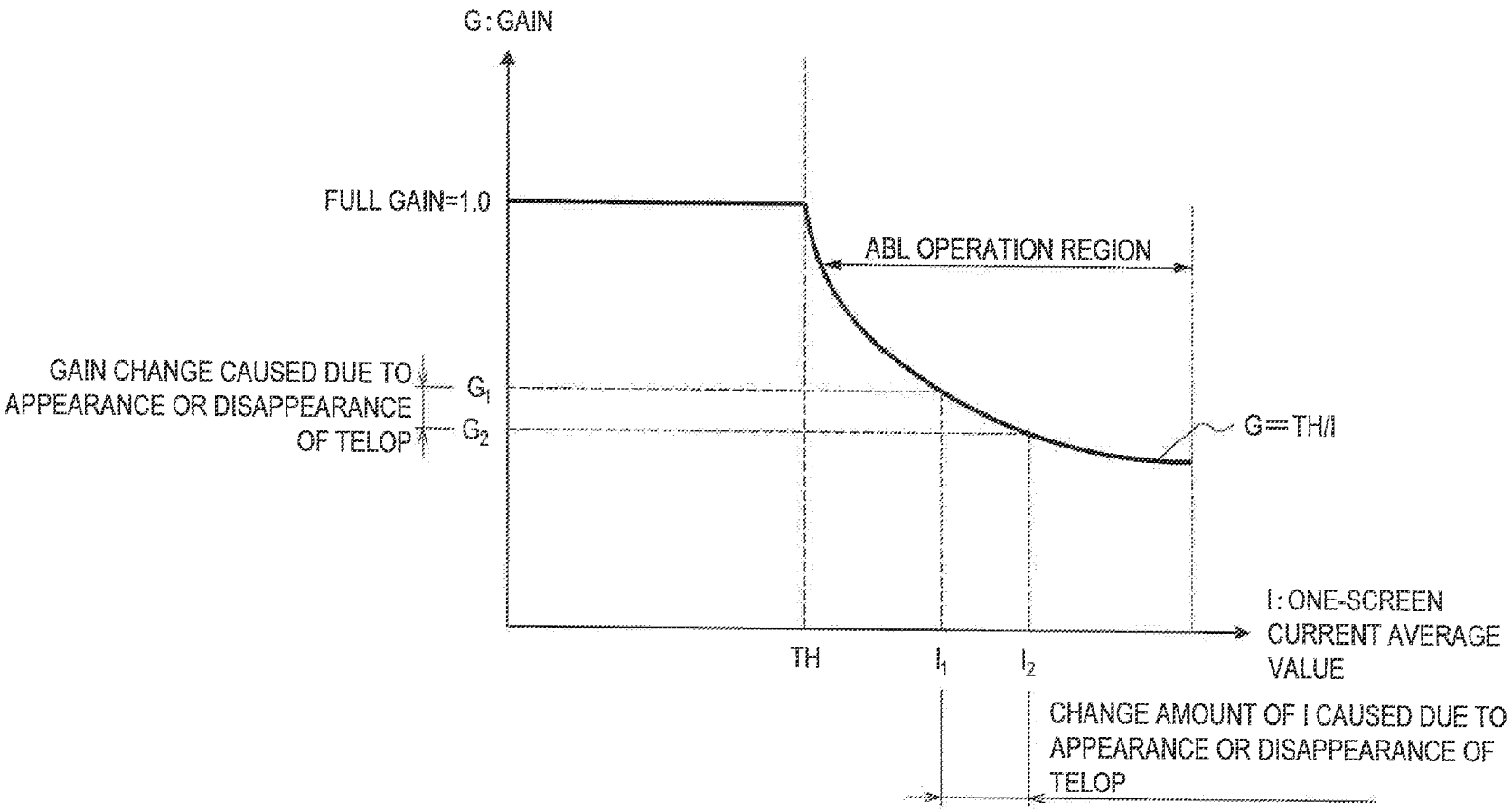
FIG. 5 is a diagram illustrating a gain change caused due to the appearance or disappearance of the telop.

1-3. Gain Change When Telop Appears or Disappears (FIG. 5)

2. Basic Configuration (ABL Control in Which Temporal Direction Control Is Performed)

Figure 6:
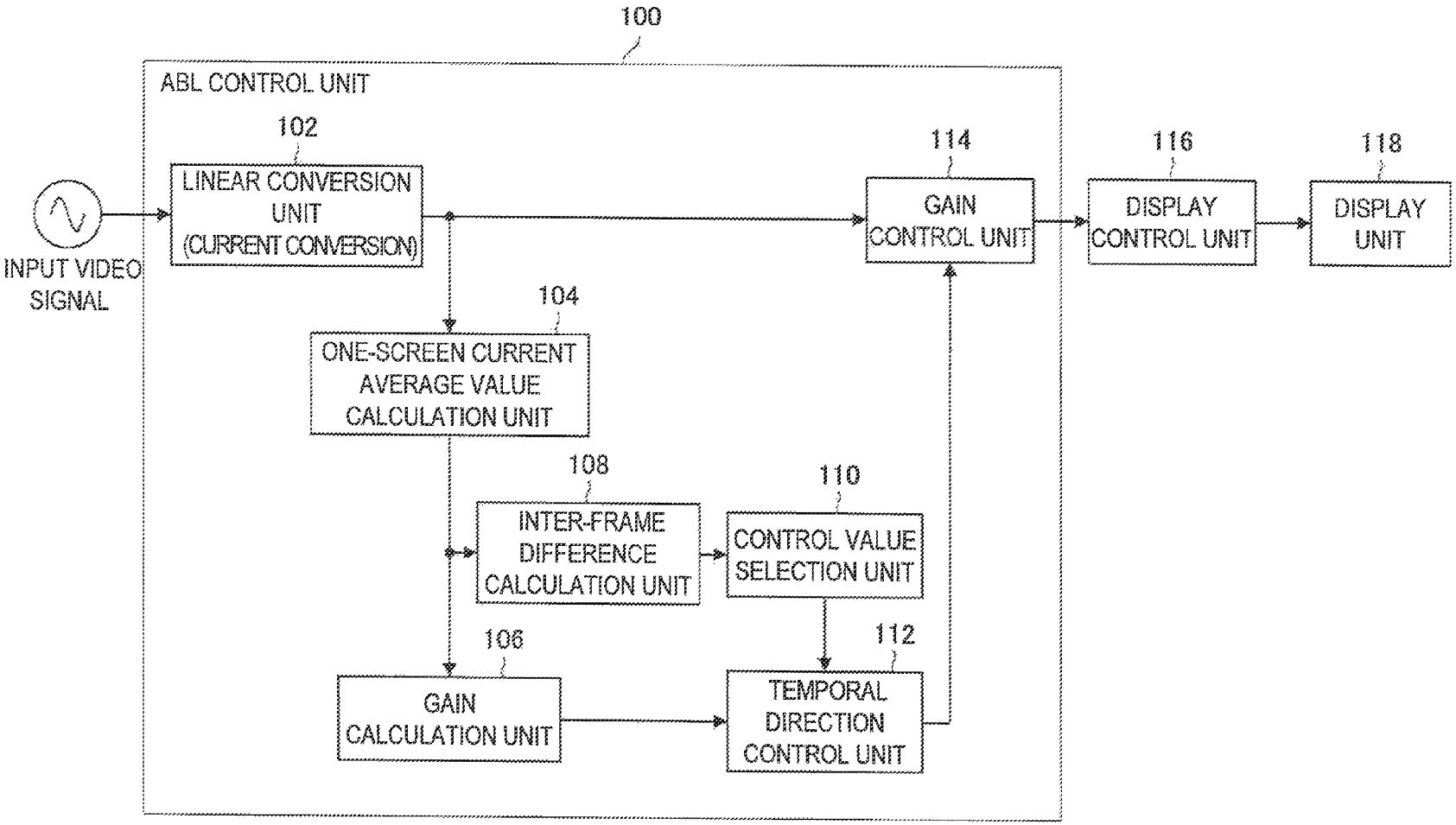
FIG. 6 is a diagram illustrating the overall configuration of a display device according to a first embodiment of the present disclosure.

2-1. Configuration of Display Device 10 (FIG. 6)

2-2. Temporal Direction Control Unit 112

Figure 7:
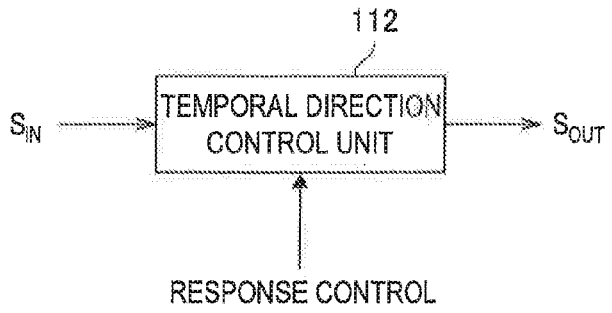
FIG. 7 is a diagram illustrating a process performed by a temporal direction control unit according to the embodiment.

2-2-1. Process Performed by Temporal Direction Control Unit 112 (FIG. 7)

Figure 8:
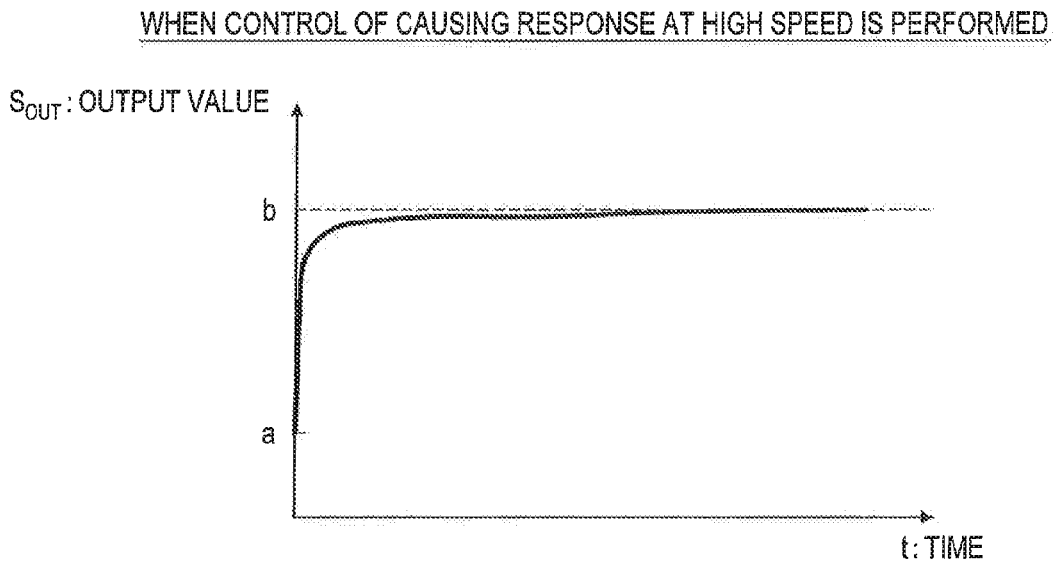
FIG. 8 is a diagram illustrating a temporal change of an output value when control of causing a gain to respond at high speed is performed.

2-2-2. Case in Which Control of Causing Gain to Respond at High Speed Is Performed (FIG. 8)

Figure 9:
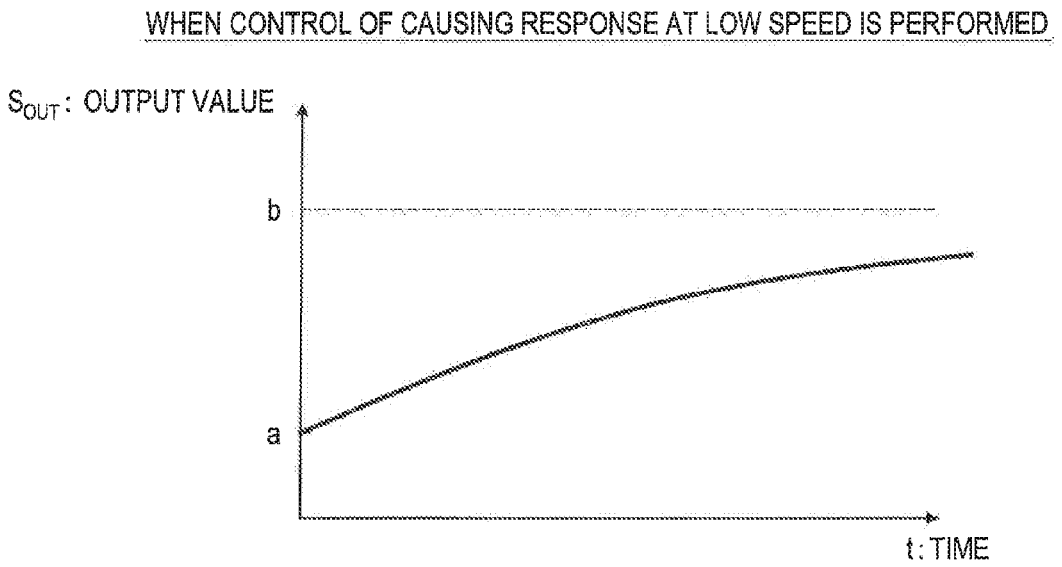
FIG. 9 is a diagram illustrating a temporal change of an output value when control of causing a gain to respond at low speed is performed.

2-2-3. Case in Which Control of Causing Gain to Respond at Low Speed Is Performed (FIG. 9)

Figure 10:
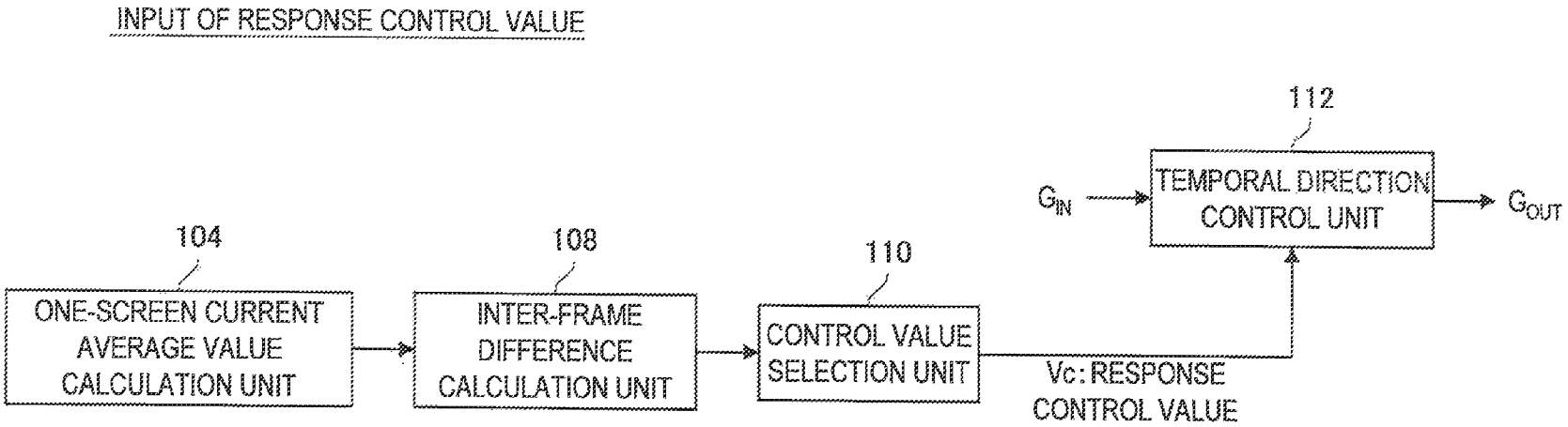
FIG. 10 is a diagram illustrating a response control value input to the temporal direction control unit according to the embodiment.

2-2-4. Response Control Value to Be Input (FIG. 10)

Figure 11:
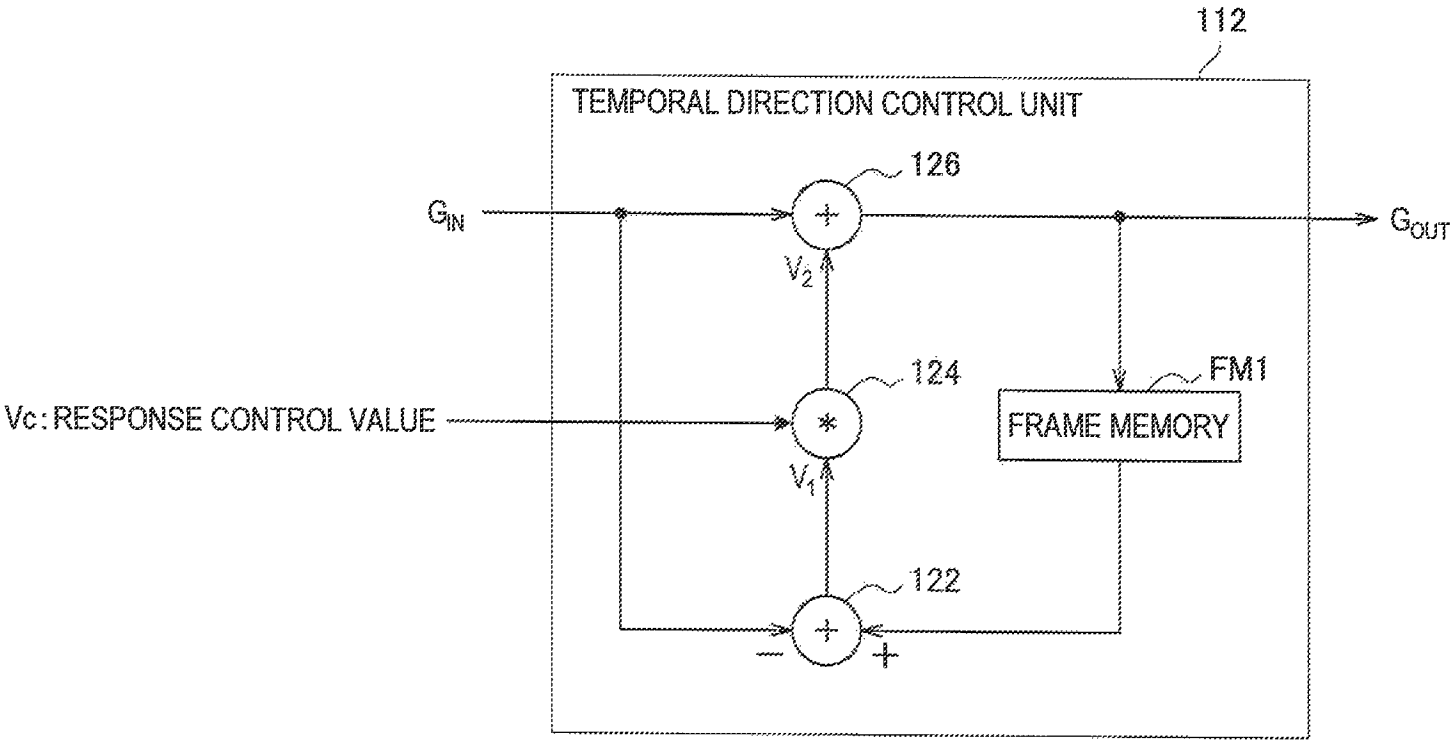
FIG. 11 is a diagram illustrating an example of the configuration of the temporal direction control unit according to the embodiment.

2-2-5. Example of Configuration of Temporal Direction Control Unit 112 (FIG. 11)

Figure 12:
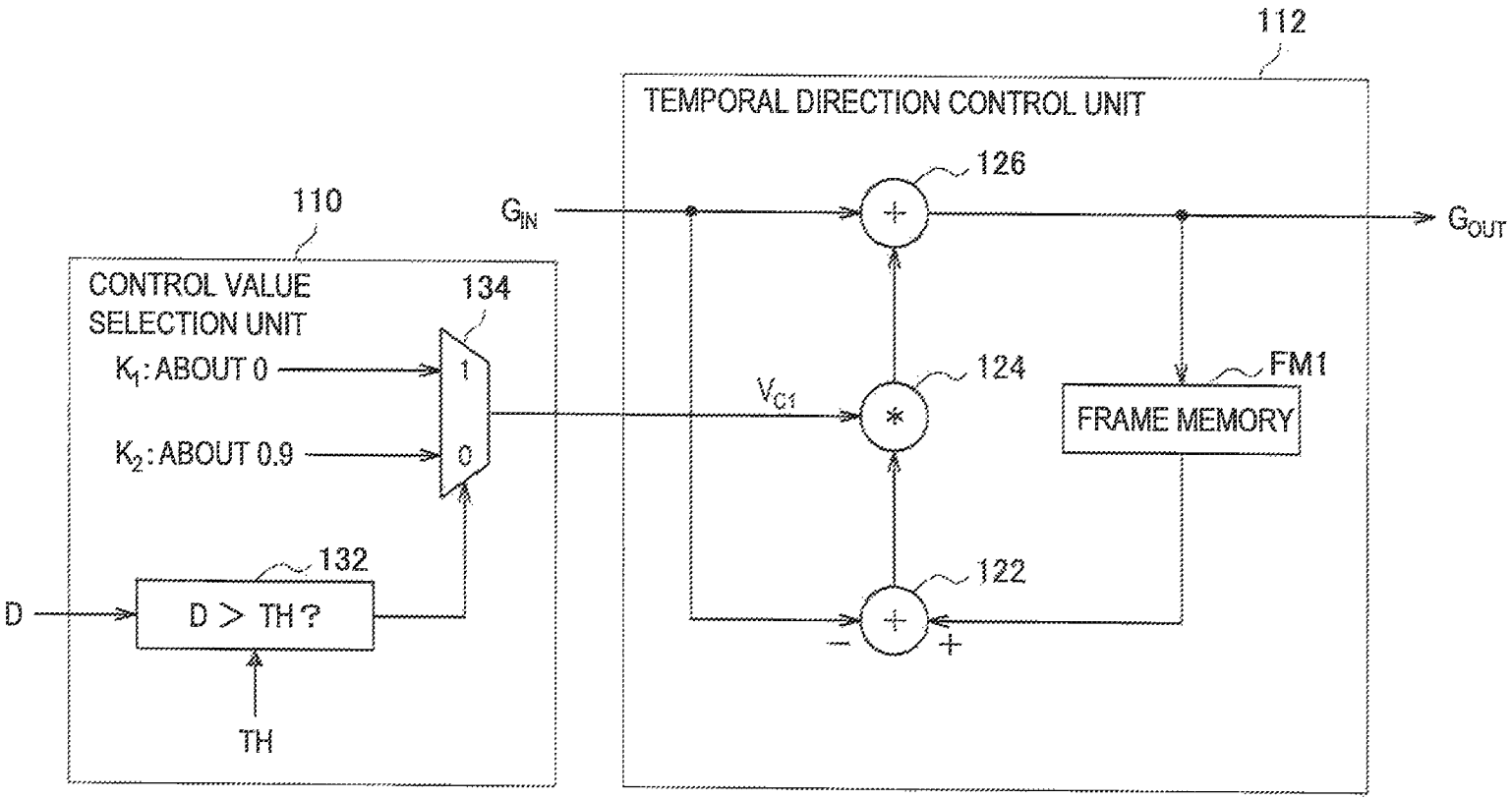
FIG. 12 is a diagram illustrating an example of the configuration of a control value selection unit according to the embodiment.

2-3. Process Performed by Control Value Selection Unit 110 (FIG. 12)

Figure 13:
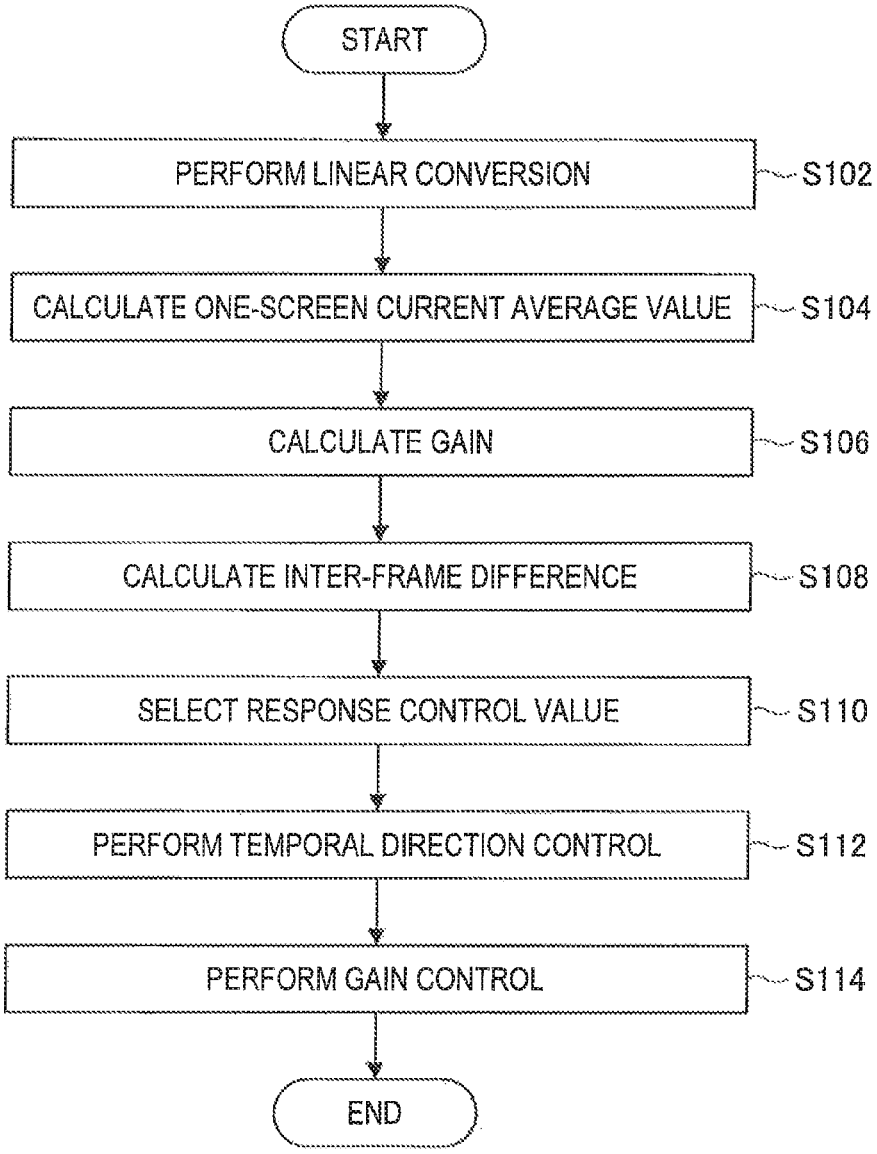
FIG. 13 is a diagram illustrating an example of the flow of a process performed by an ABL control unit according to the embodiment.

2-4. Flow of Process 2-4-1. Flow of Process Performed by ABL Control Unit 100 (FIG. 13)

Figure 14:
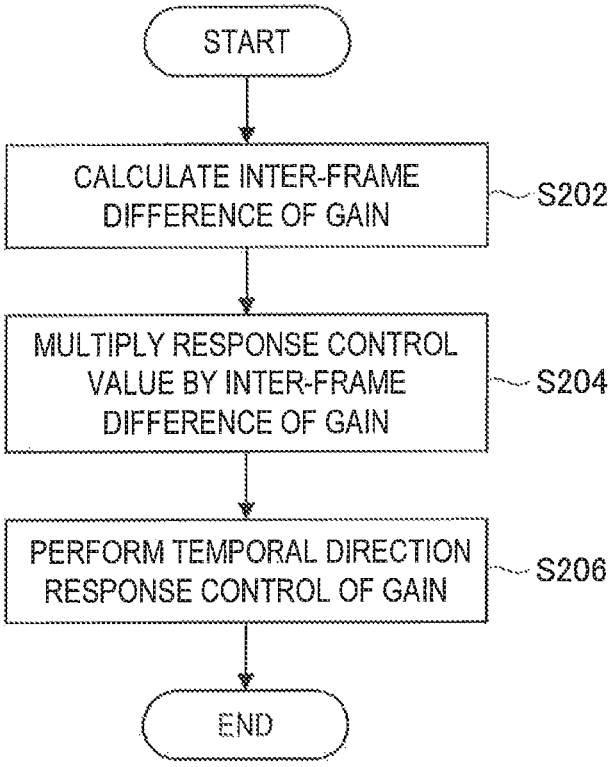
FIG. 14 is a diagram illustrating an example of the flow of a process performed by the temporal direction control unit according to the embodiment.

2-4-2. Flow of Process Performed by Temporal Direction Control Unit 112 (FIG. 14)

Figure 15:
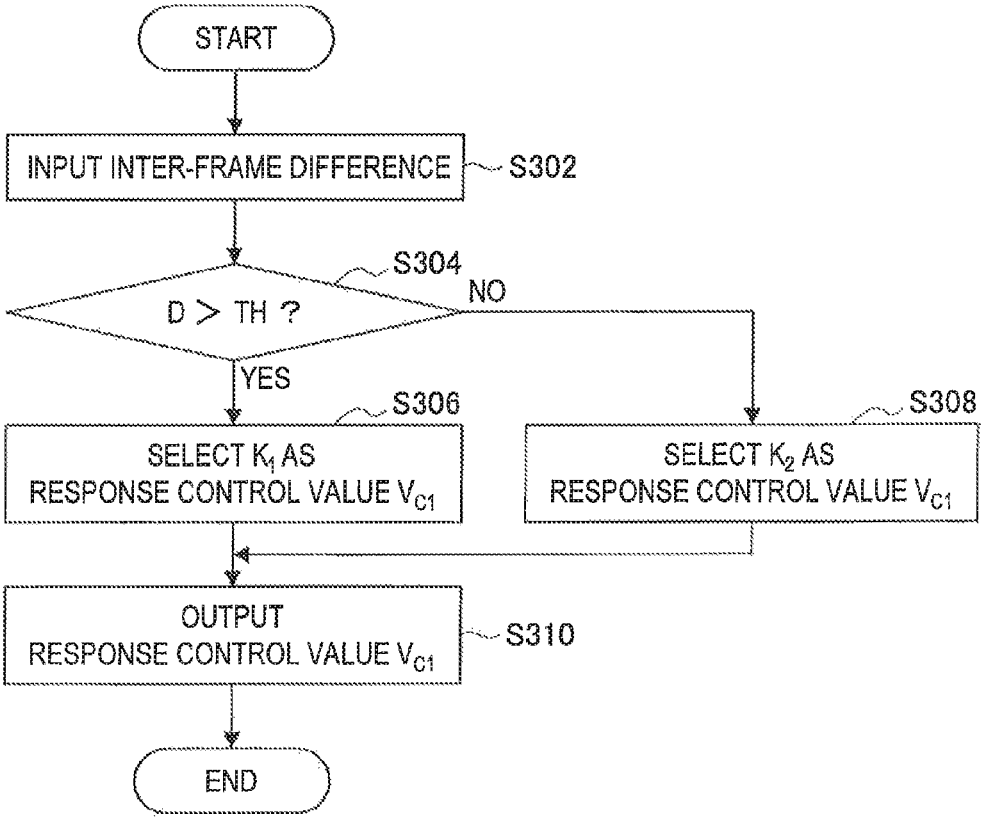
FIG. 15 is a diagram illustrating an example of the flow of a process performed by the control value selection unit according to the embodiment.

2-4-3. Flow of Process Performed by Control Value Selection Unit 110 (FIG. 15)

Figure 16:
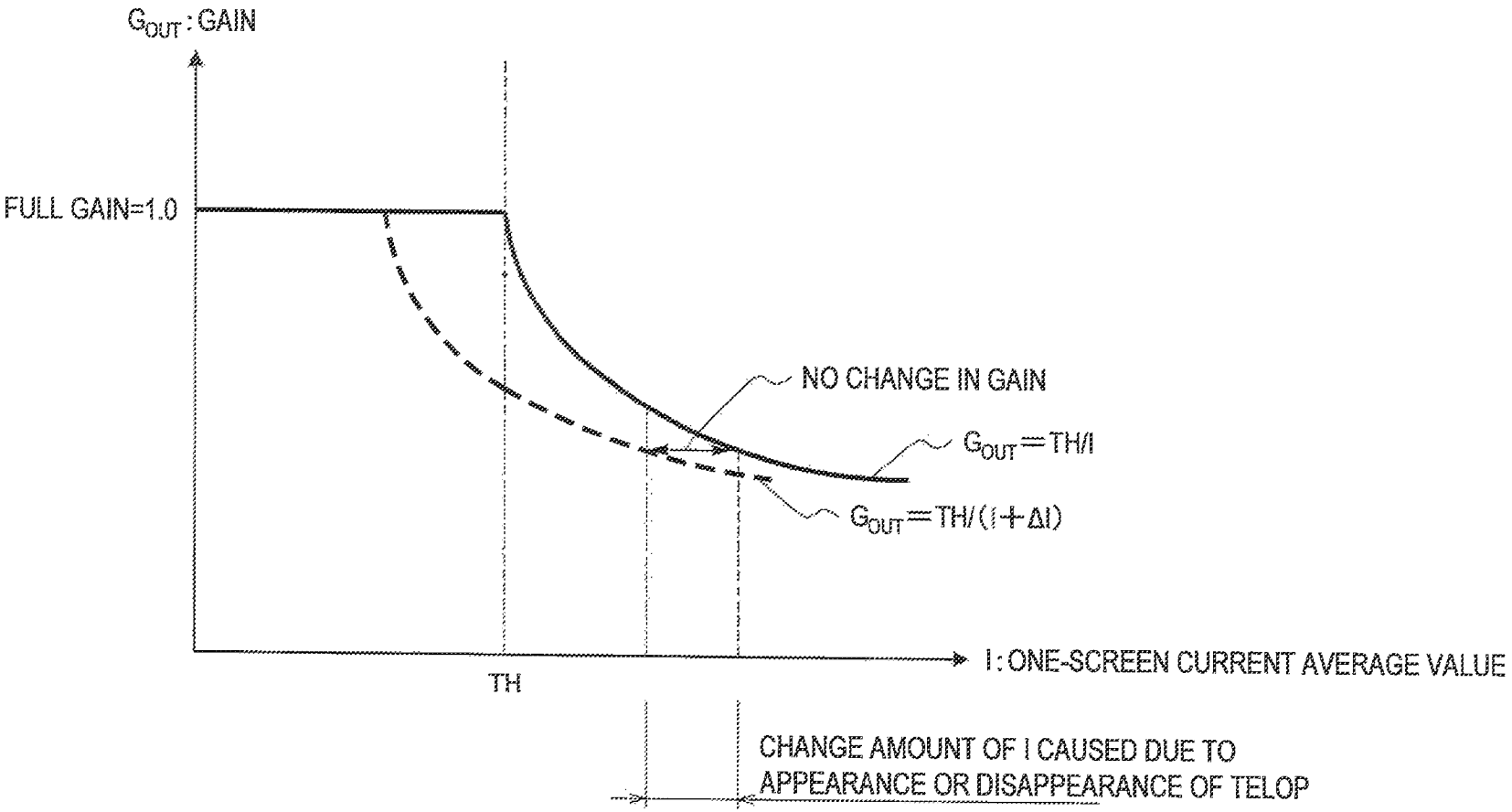
FIG. 16 is a diagram illustrating advantages according to the embodiment.

2-5. Advantages of Temporal Direction Control (FIG. 16)

Figure 17:
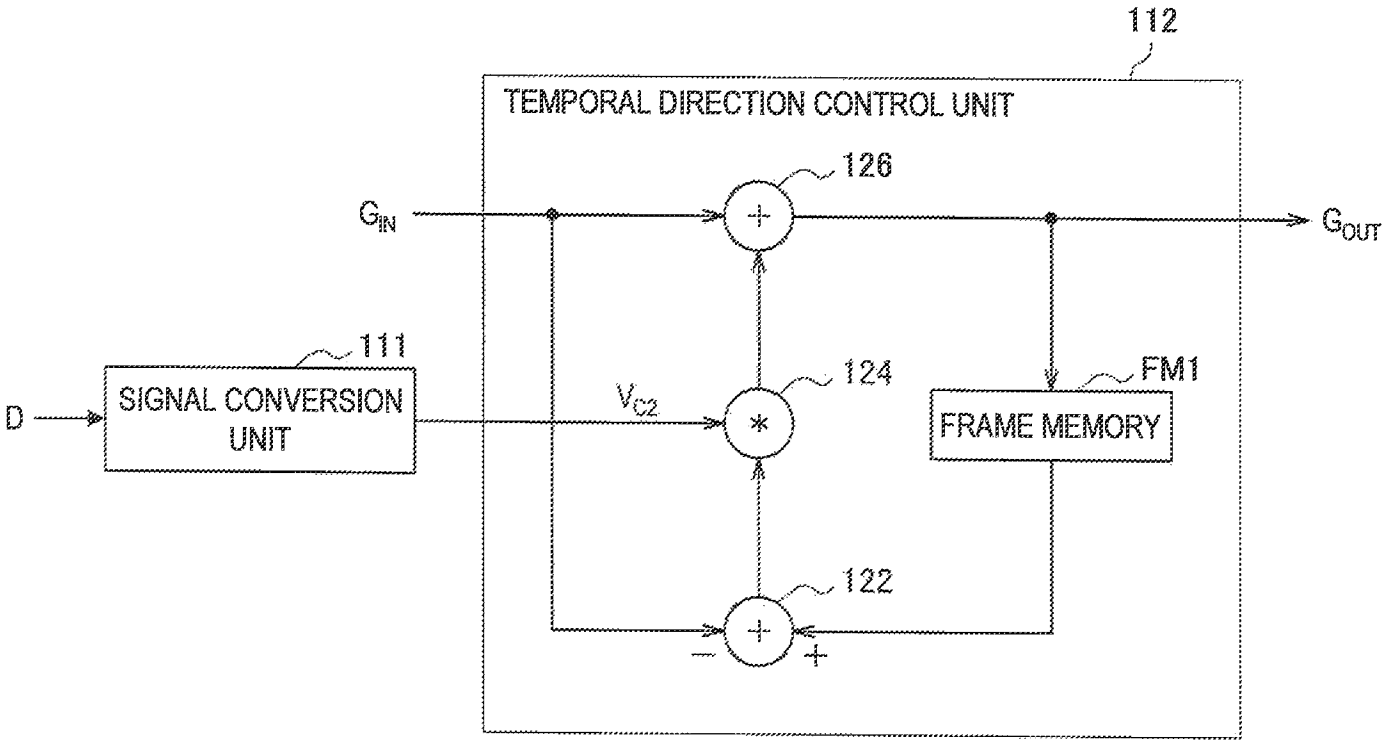
FIG. 17 is a diagram for describing a first modification example of the technology of the embodiment.

3. Modification Examples 3-1. First Modification Example (Calculation of Response Control Value by Signal Conversion: FIG. 17)

Figure 18:
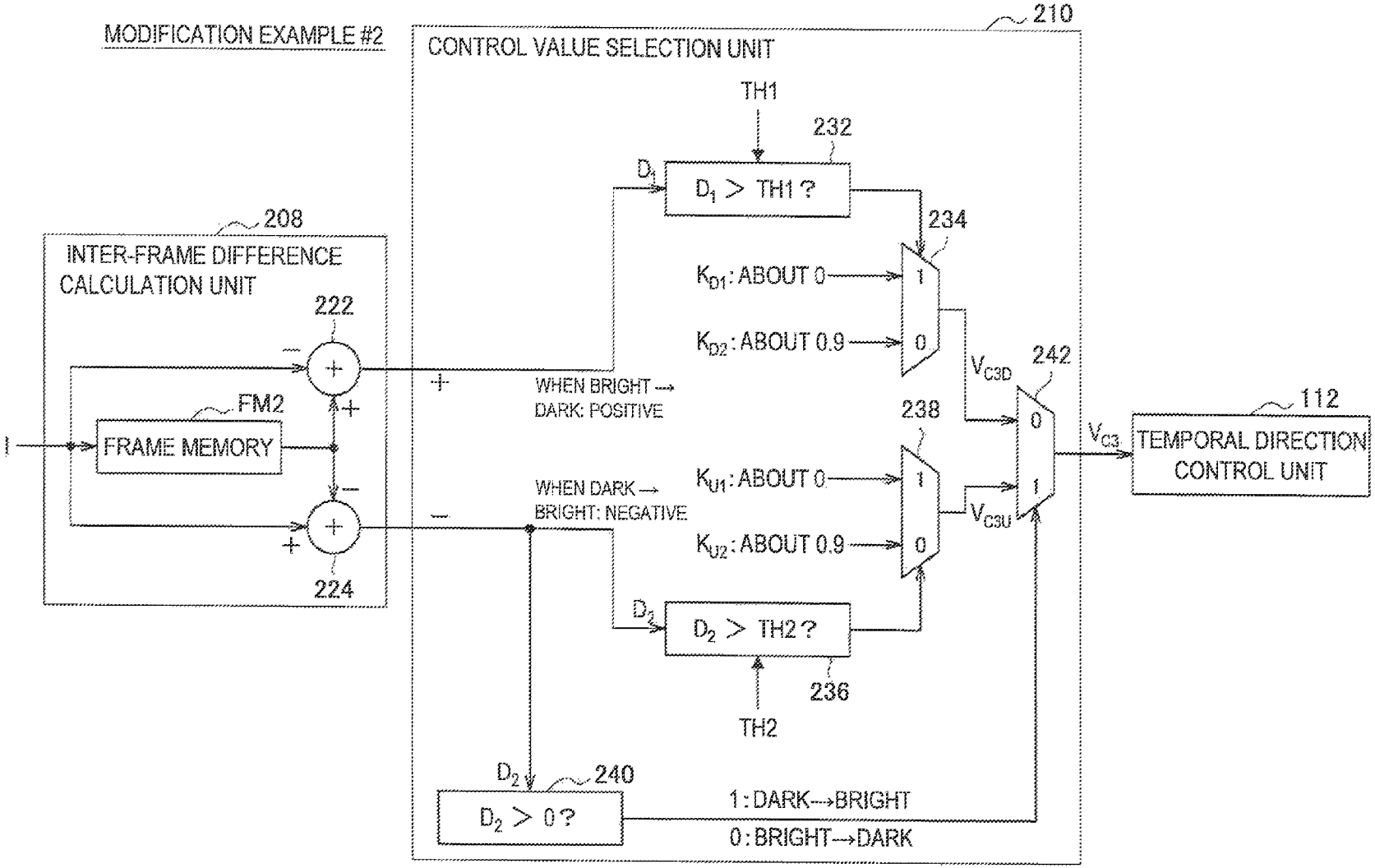
FIG. 18 is a diagram for describing a second modification example of the technology of the embodiment.

3-2. Second Modification Example (Selection of Response Control Value Based on Two Threshold Values: FIG. 18)

Figure 19:
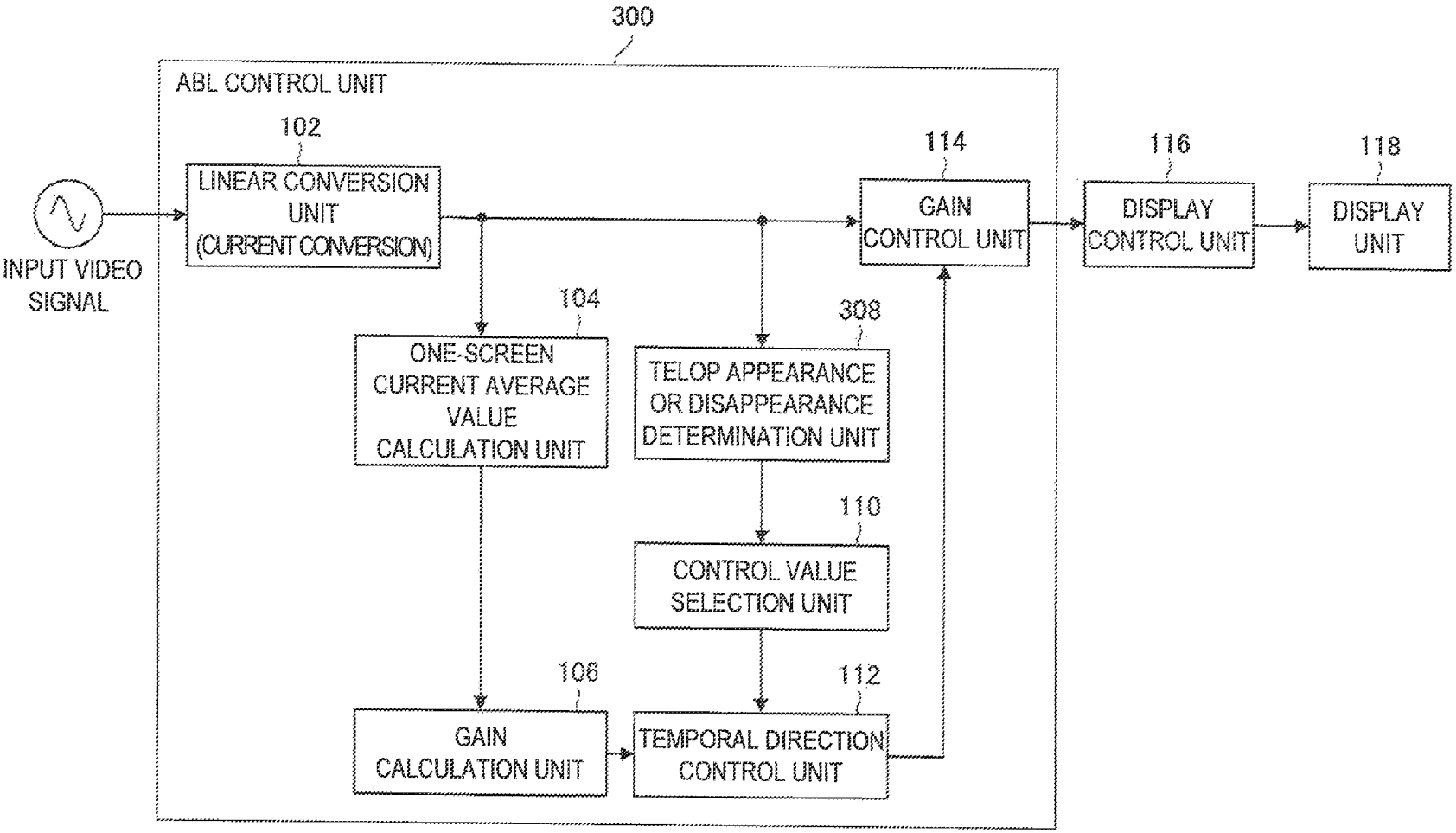
FIG. 19 is a diagram for describing a third modification example of the technology of the embodiment.

3-3. Third Modification Example (Use of Telop Presence and Absence Information: FIG. 19)

Figure 20:
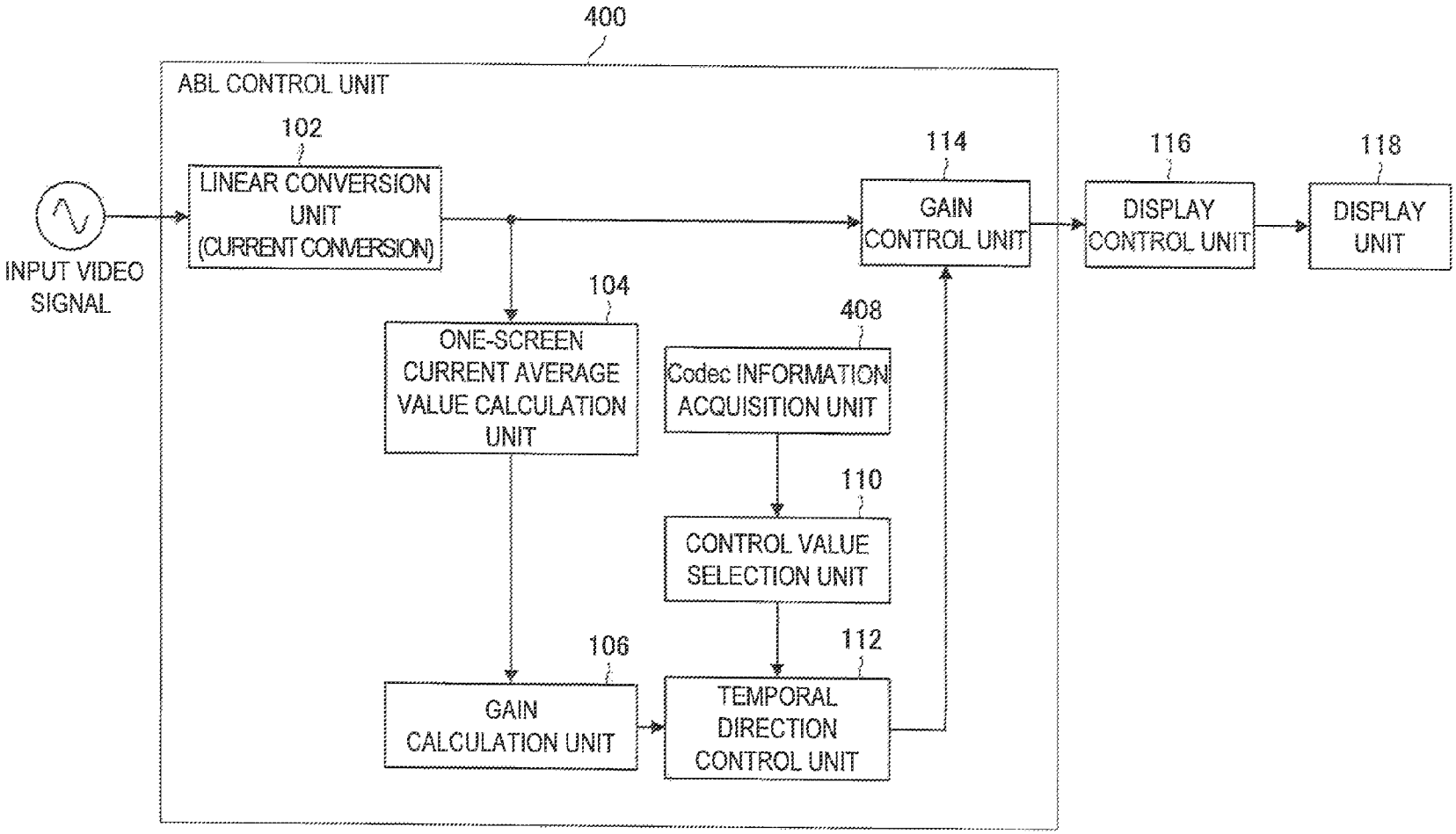
FIG. 20 is a diagram for describing a fourth modification example of the technology of the embodiment.

3-4. Fourth Modification Example (Use of Codec Information: FIG. 20)

4. Summarization

1. Introduction

1-1. ABL Control in which Temporal Direction Control is not Performed (FIG. 1)

First, ABL control in which temporal direction control is not performed will be described with reference to FIGS. 1 to 3.

The ABL control is performed on a self-luminous type display device such as an organic light-emitting diode (OLED) display, a field emission display (FED), a surface-conduction electron-emitter display (SED), or a plasma display panel (PDP).

FIG. 1 is a diagram illustrating the ABL control in which the temporal direction control is not performed. As shown in FIG. 1, an image signal or a video signal is input to a display device including an ABL control unit 500. However, the image signal or the video signal may not be a signal configured to realize an optimum display state when the signal is displayed on a display unit 118 to be described below.

Therefore, a linear conversion unit 102 of the ABL control unit 500 performs linear conversion (window level conversion) to convert the input image signal or the input video signal into an optimum signal for the display unit 118. An overview of the linear conversion and a process performed by the linear conversion unit 102 will be described below.

The linear conversion is a process of converting an image signal or a video signal compressed in a γ space into a value proportional to an optical intensity (luminance). As described above, since luminance and a current value have a proportional relation, the process of converting an image signal or a video signal into luminance is equivalent to a process of converting an image signal or a video signal into a current value.

Figure 2:
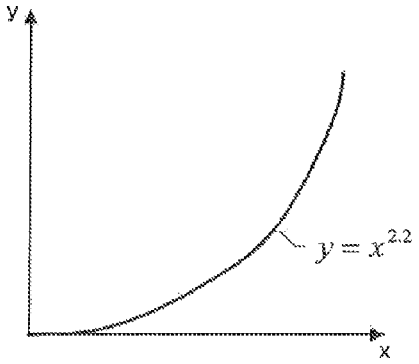
FIG. 2 is a diagram illustrating linear conversion.

FIG. 2 is a diagram illustrating the linear conversion. Here, x represents an image signal or a video signal compressed in a γ space. Further, y represents a signal proportional to an optical intensity (luminance). In the linear conversion, for example, as shown in FIG. 2, an image signal or a video signal x compressed in the γ space is converted into a signal y proportional to the optical intensity (luminance) according to a function $y=x^{2.2}$.

The overview of the linear conversion and the process performed by the linear conversion unit 102 has been described. Next, a process performed by a one-screen current average value calculation unit 104 will be described.

A current value is input as the image signal converted by the linear conversion unit 102 to the one-screen current average value calculation unit 104. The one-screen current average value calculation unit 104 calculates an average value of the current values of the pixels included in the input image. Further, when the video signal is input to the one-screen current average value calculation unit 104, an average value of the current values of the pixels included in each frame is calculated.

In the embodiment of the present disclosure, an average value of the current values calculated for the pixels included in an input image or the pixels included in each frame of an input video signal is referred to as a one-screen current average value. The one-screen current average value calculation unit 104 outputs the calculated one-screen current average value to a gain calculation unit 106. Further, one screen indicates a one-screen image in an image signal or one frame in a video signal.

The gain calculation unit 106 calculates a gain used to adjust the luminance of each screen based on the input one-screen current average value. A gain calculation method of the gain calculation unit 106 is classified as one of the following two methods based on the input one-screen current average value.

(Case in which Input One-Screen Current Average Value is Smaller than Threshold Value TH)

The gain calculation unit 106 calculates a gain G as 1.0 (full gain). When the input one-screen current average value I is equal to or less than a threshold value TH, this value is input to the display unit 118 without change. This is because no overcurrent flows in a light-emitting element of the display unit 118.

(Case in which Input One-Screen Current Average Value is Equal to or Less than Threshold Value TH)

The gain calculation unit 106 calculates the gain G according to a function G=TH/I. Further, I is the one-screen current average value input to the gain calculation unit 106. The gain G is calculated such that the gain G is smaller in inverse proportion to the one-screen current average value I as the input one-screen current average value I is larger.

When the input one-screen current average value I is equal to or greater than the threshold value TH and the unchanged value is input to the display unit 118, an overcurrent flows in the light-emitting element of the display unit 118. Therefore, by adjusting the gain G to be inversely proportional to the one-screen current average value I, the overcurrent is prevented from flowing in the light-emitting element of the display unit 118.

When the gain calculation unit 106 calculates the gain according to one of the two gain calculation methods, the calculated gain is output to the gain control unit 114.

As described above, the image signal or the video signal converted by the linear conversion unit 102 is input to the gain control unit 114. Further, as described above, the gain of each screen calculated by the gain calculation unit 106 is input to the gain control unit 114.

The gain control unit 114 generates an image signal or a video signal to be input to the display unit 118 by multiplying the current value of each pixel included in the image or the video subjected to the linear conversion by the calculated gain.

When the calculated one-screen current average value is less than the threshold value TH, the image signal or the video signal subjected to the linear conversion is input to the display unit 118 without change. Conversely, when the calculated one-screen current average value is equal to or greater than the threshold value TH, a value obtained by multiplying the current value of the image signal or the video signal subjected to the linear conversion by the gain G is input as the image signal or the video signal to the display unit 118.

The gain control unit 114 outputs the image signal or the video signal subjected to the gain control to the display control unit 116. The display control unit 116 performs display control of the display unit 118 based on the input image signal or the input video signal. When a signal of a γ space is necessary in the input of the image signal to the display unit 118, it is necessary for the linear conversion unit 102 to convert the signal subjected to the linear conversion into a signal of the γ space again. When a signal proportional to an optical intensity (luminance) is necessary in the input of the image signal to the display unit 118, the signal subjected to the linear conversion may be used.

Figure 3:
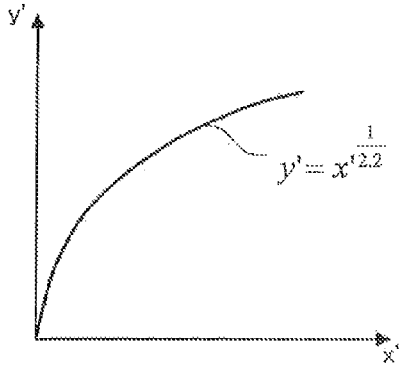
FIG. 3 is a diagram illustrating γ conversion.

FIG. 3 is a diagram illustrating γ conversion. Here, x' indicates a signal proportional to the optical intensity (luminance). Further, y' indicates an image signal or a video signal compressed in the γ space. In the γ conversion, for example, as shown in FIG. 3, the signal x' proportional to the optical intensity (luminance) is converted again into a signal y' of the γ space according to a function $x'^{1/2.2}$.

The ABL control in which the temporal direction control is not performed has been described with reference to FIGS. 1 to 3.

1-2. Example of ABL Control when Telop Appears or Disappears (FIG. 4)

Next, a phenomenon occurring in the ABL control when a video signal in which a telop appears or disappears in the middle of a picture is input will be described with reference to FIG. 4. FIG. 4 is a diagram illustrating the ABL control when a telop appears or disappears.

As shown in FIG. 4, a case in which a human $H_1$, a background $B_1$, and a telop $T_1$ are included in a frame $P_1$ to be subjected to the ABL control will be considered. Here, it is assumed that no telop is included in a frame $P_0$ previous to the frame $P_1$ and a telop appears in the frame $P_1$.

It is necessary for the ABL control unit 100 to perform a process on the input video signal in real time and output the video signal to the display unit 118. Therefore, in the ABL control, a gain used to control the input video signal is generally calculated for each frame. That is, the input video signal is not controlled for each pixel included in a frame.

When the telop $T_1$ appears, a current average value of the entire frame $P_1$ becomes higher. When the one-screen current average value of the frame $P_1$ is equal to or greater than the threshold value TH in the calculation of the gain, the input frame $P_1$ is controlled as in a frame $P_{1ABL}$ through the ABL control and is displayed on the display unit 118.

As shown in FIG. 4, in the frame $P_{1ABL}$ obtained after the ABL control, a portion, such as a human $H_{1ABL}$ or a background $B_{1ABL}$, in which a luminance is desired to be stable, other than a telop $T_{1ABL}$ may be instantly darkened in some cases, when the telop appears.

Further, when the telop disappears, a change in the luminance may occur. Even in this case, the ABL control on the entire screen may result in the instant change in the luminance of the portion of the human or the background other than the telop.

The phenomenon occurring in the ABL control when a video signal in which a telop appears or disappears in the middle of a picture is input has been described with reference to FIG. 4.

1-3. Gain Change when Telop Appears or Disappears (FIG. 5)

Next, a gain change caused due to the appearance or disappearance of a telop will be described with reference to FIG. 5. FIG. 5 is a diagram illustrating the gain change caused due to the appearance or disappearance of a telop.

As shown in FIG. 5, the gain calculation unit 106 calculates a gain G as a full gain of 1.0 until the input one-screen current average value I is the threshold value TH. The gain calculation unit 106 calculates the gain G according to a function G=TH/I in an ABL operation region in which the input one-screen current average value I is equal to or greater than the threshold value TH.

When the one-screen current average value I increases from $I_1$ to $I_2$ due to the appearance of a telop in the ABL operation region, the gain G decreases from $G_1$ to $G_2$ with the increase. Further, when the one-screen current average value I decreases from $I_2$ to $I_1$ due to disappearance of the telop, the gain G increases from $G_2$ to $G_1$ with the decrease.

Thus, even when the input signal of only a part of a screen is changed due to, for example, the appearance or disappearance of the telop, the gain of the screen may be changed and the luminance of the screen obtained after the ABL control may be changed in a short time. The sharp change in the luminance of temporally continuous moving image contents in the temporal direction is easily perceived by a human and causes a deterioration in image quality.

On the other hand, when an input signal of the entire screen is changed in reproduction of moving image contents, it is also necessary to adjust the gain quickly so that an overcurrent does not flow in terms of protection of the light-emitting element of the display unit 118 or a power source.

As the result of thorough examination based on such a phenomenon, the present inventors have devised the following technology capable of appropriately selecting fast adjustment of the gain with respect to the input video signal (in other words, the gain is caused to respond at high speed) or slow adjustment of the gain (in other words, the gain is caused to respond at low speed).

Specifically, the present inventors have contrived ABL control in which the gain is caused to respond to the input video signal at high speed when the current value of the video signal input to the display device sharply increases, whereas the gain is caused to respond to the input video signal at low speed when the current value of the video signal input to the display device gently increases.

2. Basic Configuration (ABL Control in which Temporal Direction Control is Performed)

2-1. Configuration of Display Device 10 (FIG. 6)

Next, the entire configuration of the display device 10 according to the first embodiment of the present disclosure will be described with reference to FIG. 6. FIG. 6 is a diagram illustrating the entire configuration of the display device 10 according to the first embodiment of the present disclosure. The display device 10 is, for example, a digital still camera capable of photographing a still image, a video camera capable of photographing a moving image, or a cellular phone, a game device, an information terminal, or a personal computer having the same imaging function as the digital still camera or the video camera.

The entire configuration of the display device 10 shown in FIG. 6 is merely an example, and some of the constituent units may be changed, added, or deleted. The entire configuration of the display device 10 will be described below with reference to FIG. 6. Here, the basic configuration of the display device 10 to be shown will be described on the assumption of a case in which the luminance of a video increases mainly due to appearance or the like of a telop. This is because a case in which the ABL control is necessary is mainly a case in which the luminance of a video instantly increases.

The display device 10 mainly includes an ABL control unit 100, the display control unit 116, and the display unit 118. The ABL control unit 100 includes a linear conversion unit 102, a one-screen current average value calculation unit 104, a gain calculation unit 106, an inter-frame difference calculation unit 108, a control value selection unit 110, a temporal direction control unit 112, and a gain control unit 114.

Among the constituent units of the ABL control unit 100, the functions of the linear conversion unit 102, the one-screen current average value calculation unit 104, the gain calculation unit 106, and the gain control unit 114 are the same as those of the constituent units of the ABL control unit 500 which does not perform the temporal direction control.

A video signal input to the display device 10 is subjected to linear conversion by the linear conversion unit 102. The linear conversion unit 102 outputs the video signal subjected to the linear conversion to the one-screen current average value calculation unit 104 and the gain control unit 114.

When the one-screen current average value calculation unit 104 calculates a one-screen current average value of each frame of the video signal, the one-screen current average value calculation unit 104 outputs the calculated one-screen current average value to the gain calculation unit 106 and the inter-frame difference calculation unit 108.

When the gain calculation unit 106 calculates the gain based on the one-screen current average value, the gain calculation unit 106 outputs the calculated gain to the temporal direction control unit 112.

The inter-frame difference calculation unit 108 calculates a difference (hereinafter referred to as an inter-frame difference) between a one-screen current average value of an input frame and a one-screen current average value of a previously input frame of the frame. The inter-frame difference calculation unit 108 outputs the calculated inter-frame difference to the control value selection unit 110.

When the luminance of only a partial region included in a frame is changed due to, for example, the appearance or disappearance of a telop, the change in the one-screen current average value of the entire frame is small. Therefore, the inter-frame difference is smaller, compared to a case, such as a scene changeover of moving image contents, in which the luminance of the entire frame is changed.

That is, by calculating the inter-frame difference, it is possible to determine whether the luminance of the entire frame of an input video signal is changed or only the luminance of a part of the frame of an input video signal is changed.

The control value selection unit 110 selects a response control value of the temporal direction control unit from two kinds of values based on the input inter-frame difference. The details of a process performed by the control value selection unit 110 will be described below. The control value selection unit 110 outputs the calculated response control value to the temporal direction control unit 112.

The temporal direction control unit 112 controls the temporal direction characteristics of the gain input from the gain calculation unit 106 based on the response control value input from the control value selection unit 110. Specifically, the gain calculation unit 106 increases or decreases the response speed of the gain with respect to the input video signal by adjusting the gain calculated by the gain calculation unit 106 based on the response control value.

A process performed by the temporal direction control unit 112 will be described below. The temporal direction control unit 112 outputs the adjusted gain to the gain control unit 114.

The gain control unit 114 performs gain control of the video signal based on the video signal subjected to the linear conversion and input from the linear conversion unit 102 and the gain input from the temporal direction control unit 112. The display control unit 116 performs display control of the display unit 118 based on the video signal obtained after the gain control.

One frame is a unit of the process performed by each unit, but the technical application scope of this embodiment of the present disclosure is not limited thereto. For example, one frame may be divided into a plurality of regions, an average current value of each of the divided regions may be calculated, and the gain control may be performed based on the calculated average current values.

In the above-described configuration, the ABL control appropriate for each frame region can be performed.

The entire configuration of the display device 10 has been described with reference to FIG. 6.

2-2. Temporal Direction Control Unit 112

2-2-1. Process Performed by Temporal Direction Control Unit 112 (FIG. 7)

Next, a process performed by the temporal direction control unit 112 will be described below with reference to FIGS. 7 to 9. FIG. 7 is a diagram illustrating the process performed by the temporal direction control unit 112 according to this embodiment, FIG. 8 is a diagram illustrating a temporal change of an output value when control of causing the gain to respond at high speed is performed. FIG. 9 is a diagram illustrating a temporal change of an output value when control of causing the gain to respond at low speed is performed.

As shown in FIG. 7 the temporal direction control unit 112 controls a response speed of an output value $S_{OUT}$ with respect to an input value $S_{IN}$. In the temporal direction control unit 112, a case in which the response speed of the output value $S_{OUT}$ with respect to an input value $S_{IN}$ is low refers to a case in which the change of the output value $S_{OUT}$ is small even when the input value $S_{IN}$ is changed. In other words, the temporal direction control unit 112 calculates the output value $S_{OUT}$ so that the value of the immediately previous output value $S_{OUT}$ is maintained.

Further, a case in which the response speed of the output value $S_{OUT}$ with respect to a change in an input value $S_{IN}$ is high refers to a case in which the output value $S_{OUT}$ quickly responds when the input value $S_{IN}$ is changed.

How quickly the temporal direction control unit 112 changes the output value $S_{OUT}$ with respect to the change in the input value $S_{IN}$ can be controlled from the outside of the of the temporal direction control unit 112.

In the display device 10, the input value $S_{IN}$ of the temporal direction control unit 112 is a gain calculated by the gain calculation unit 106. Further, the output value $S_{OUT}$ of the temporal direction control unit 112 is a gain that is used when the gain control unit 114 performs the gain control on the input video signal.

2-2-2. Case in which Control of Causing Gain to Respond at High Speed is Performed (FIG. 8)

FIG. 8 shows a temporal change of the output value $S_{OUT}$ when the input value $S_{IN}$ is changed from a to b. In FIG. 8, t=0 refers to a moment at which the input value $S_{IN}$ is changed from a to b.

As shown in FIG. 8, when the control of causing the gain to respond at high speed is performed, the output value $S_{OUT}$ is also sharply changed from a to b in response to the change in the input value $S_{IN}$. The input value $S_{IN}$ input to the temporal direction control unit 112 of the display device 10 is a gain. $G_{IN}$ which is calculated by the gain calculation unit 106 based on the input video signal. Further, the output value $S_{OUT}$ from the temporal direction control unit 112 of the display device 10 is a gain $G_{OUT}$ which is input to the gain control unit 114.

As in FIG. 8, when the response control is performed by the temporal direction control unit 112, the gain $G_{OUT}$ input to the gain control unit 114 responds at high speed to the gain $G_{IN}$ calculated by the gain calculation unit 106.

That is, the gain $G_{OUT}$ input to the gain control unit 114 responds at high speed to the change in the input video signal.

As a result, by performing the display control quickly in response to the change in the input video signal, it is possible to prevent an overcurrent from flowing in the light-emitting element.

2-2-3. Case in which Control of Causing Gain to Respond at Low Speed is Performed (FIG. 9)

FIG. 9 shows a temporal change of the output value $S_{OUT}$ when the input value $S_{IN}$ is changed from a to b, as in FIG. 8.

As in FIG. 9, when the control of causing the gain to respond at low speed is performed, a time from the time t=0 at which the input value $S_{IN}$ is changed to a time at which the output value $S_{OUT}$ becomes b is lengthened, compared to FIG. 8. The output value $S_{OUT}$ is gently changed from a to b.

The input value $S_{IN}$ input to the temporal direction control unit 112 of the display device 10 is a gain $G_{IN}$ that is calculated by the gain calculation unit 106 based on the input video signal. Further, the output value $S_{OUT}$ from the temporal direction control unit 112 of the display device 10 is a gain $G_{OUT}$ that is input to the gain control unit 114.

As in FIG. 9, when the response control is performed by the temporal direction control unit 112, the gain $G_{OUT}$ input to the gain control unit 114 responds at low speed to the gain $G_{IN}$ calculated by the gain calculation unit 106.

That is, the gain $G_{OUT}$ input to the gain control unit 114 responds at low speed to the change in the input video signal.

As a result, even when a part of the input video signal is changed, the luminance of the display unit 118 is stable, and thus it is possible to prevent image quality from deteriorating.

2-2-4. Response Control Value to be Input (FIG. 10)

Next, a response control value input to the temporal direction control unit 112 will be described below with reference to FIG. 10. FIG. 10 is a diagram illustrating the response control value input to the temporal direction control unit 112 according to this embodiment.

The one-screen current average value calculation unit 104 calculates a one-screen current average value of each frame of the video signal input to the display device 10. The inter-frame difference calculation unit 108 calculates a difference (inter-frame difference) in the one-screen current average value between the frames calculated by the one-screen current average value calculation unit 104.

The control value selection unit 110 calculates a response control value $V_C$ used to perform the response control of the temporal direction control unit 112 according to the inter-frame difference calculated by the inter-frame difference calculation unit 108, and then input the calculated control value $V_C$ to the temporal direction control unit 112.

The process performed by the temporal direction control unit 112 has been described with reference to FIGS. 7 to 10.

2-2-5. Example of Configuration of Temporal Direction Control Unit 112 (FIG. 11)

Next, an example of the configuration of the temporal direction control unit 112 performing the above-described process will be described below with reference to FIG. 11. FIG. 11 is a diagram illustrating an example of the configuration of the temporal direction control unit 112 according to this embodiment.

The gain $G_{IN}$ calculated by the gain calculation unit 106 is input to the temporal direction control unit 112. The gain $G_{IN}$ input to the temporal direction control unit 112 is input to addition units 122 and 126.

Here, the gain $G_{OUT}$ calculated through various kinds of calculation of the temporal direction control unit 112 is temporarily stored in a frame memory FM1 of the temporal direction control unit 112 and is used for calculation. The value of the gain $G_{IN}$ input at a given moment and stored at the moment in the frame memory FM1 is the gain $G_{OUT}$ calculated based on the previously input gain $G_{IN}$.

The addition unit 122 adds a value obtained by inverting the sign of the input gain $G_{IN}$ and the value stored in the frame memory FM1. The addition unit 122 outputs a calculated value $V_1$ to a multiplication unit 124. The value $V_1$ output from the addition unit 122 is a value obtained by subtracting the gain $G_{IN}$ input at the given moment from the gain $G_{OUT}$ output immediately before the moment.

When the gain $G_{IN}$ smaller than the immediately output gain $G_{OUT}$ is input to the addition unit 122, the value $V_1$ output from the addition unit 122 becomes positive. Conversely, when the gain $G_{IN}$ larger than the immediately output gain $G_{OUT}$ is input to the addition unit 122, the value V output from the addition unit 122 becomes negative.

The multiplication unit 124 multiples the value $V_1$ output from the addition unit 122 by the response control value $V_C$. The multiplication unit 124 outputs a calculated value $V_2$ to the addition unit 126. The addition unit 126 adds the input gain $G_{IN}$ and the value $V_2$ input by the multiplication unit 124. The addition unit 126 outputs the calculated value as the gain $G_{OUT}$ output by the temporal direction control unit 112.

Here, the response control value $V_C$ input to the multiplication unit 124 is a value greater than 0 and less than 1. As the response control value $V_C$ is closer to 0, the influence of the value $V_1$ calculated based on the value stored in the frame memory FM1 is smaller in the calculation of the addition unit 126. That is, the gain is caused to respond at high speed according to the change in the input video signal.

Further, as the response control value $V_C$ is closer to 1, the influence of the value $V_1$ calculated based on the value stored in the frame memory FM1 is larger in the calculation of the addition unit 126. That is, even when the input video signal is changed, the gain is caused to respond at low speed so that the value of the immediately previous frame is maintained.

The example of the configuration of the temporal direction control unit 112 performing the above-described process has been described with reference to FIG. 11.

2-3. Process Performed by Control Value Selection Unit 110 (FIG. 12)

Next, an example of the configuration of the control value selection unit 110 will be described below with reference to FIG. 12. FIG. 12 is a diagram illustrating an example of the configuration of the control value selection unit 110 according to this embodiment.

As described above, the control value selection unit 110 outputs the response control value $V_C$ to the temporal direction control unit 112. Hereinafter, a case in which a value $V_{C1}$ selected from binary values of $K_1$ and $K_2$ which are values set in advance by the control value selection unit 110 is output as the response control value $V_C$ to the temporal direction control unit 112 will be described.

The value $K_1$ is a response control value used to cause the temporal direction control unit 112 to perform the response control at high speed and is set to, for example, about 0. Further, the value $K_2$ is a response control value used to cause the temporal direction control unit 112 to perform the response control at low speed and is set to, for example, about 0.9.

As shown in FIG. 12, an inter-frame difference D input to the control value selection unit 110 is input to a determination unit 132 of the control value selection unit 110. The determination unit 132 determines whether the inter-frame difference D is greater than the threshold value TH set in advance.

When the inter-frame difference D is greater than the threshold value TH, the determination unit 132 outputs 1 (true) to a selector 134. Conversely, when the inter-frame difference D is equal to or less than the threshold value TH, the determination unit 132 outputs 0 (false) to the selector 134.

When 1 is input from the determination unit 132, the selector 134 selects the value $K_1$ used to perform the high-speed response control as the response control value $V_{C1}$ and outputs the value $K_1$ to the multiplication unit 124 of the temporal direction control unit 112. Conversely, when 0 is input from the determination unit 132, the selector 134 selects the value $K_2$ used to perform the low-speed response control as the response control value $V_{C1}$ and outputs the value $K_2$ to the multiplication unit 124 of the temporal direction control unit 112.

The case in which the response control value $K_1$ is set to about 0 has been described, but the embodiment of the present disclosure is not limited thereto. The value may be a response control value used to cause the gain to respond at high speed. Further, the case in which the response control value $K_2$ is set to about 0.9 has been described, but the embodiment of the present disclosure is not limited thereto. The value may be a response control value used to cause the gain to respond at low speed.

The example of the configuration of the control value selection unit 110 has been described with reference to FIG. 12.

2-4. Flow of Process

2-4-1. Flow of Process Performed by ABL Control Unit 100 (FIG. 13)

Next, the flow of a process performed by the ABL control unit 100 will be described below with reference to FIG. 13. FIG. 13 is a diagram illustrating an example of the flow of a process performed by the ABL control unit 100 according to this embodiment.

As shown in FIG. 13, the linear conversion unit 102 first performs linear conversion on the input video signal (S102).

Next, the one-screen current average value calculation unit 104 calculates a one-screen current average value of each frame of the video signal obtained after the linear conversion (S104).

Next, the gain calculation unit 106 calculates the gain used to adjust the luminance of each frame based on the calculated one-screen current average value. (S106).

Next, the inter-frame difference calculation unit 108 calculates the difference (inter-frame difference) in the calculated one-screen current average value between the frames (S108).

Next, the control value selection unit 110 selects the response control value used to perform the response control of the temporal direction control unit 112 based on the calculated inter-frame difference (S110).

Next, the temporal direction control unit 112 performs the temporal direction response control of the calculated gain (S112). At this time, the response speed of the gain is adjusted by the temporal direction control unit 112.

Next, the gain control unit 114 performs the gain control of the signal input from the linear conversion unit 102 using the gain subjected to the temporal direction response control (S114). When the gain control unit 114 performs the gain control, the gain control unit 114 outputs the signal obtained after the gain control to the display control unit 116. Thereafter, the ABL control unit 100 ends the series of processes concerning the ABL control.

The flow of the process performed by the ABL control unit 100 has been described with reference to FIG. 13. The processing order of some processing steps may be switched.

(2-4-2. Flow of Process Performed by Temporal Direction Control Unit 112 (FIG. 14)

Next, the flow of a process performed by the temporal direction control unit 112 will be described below with reference to FIG. 14. FIG. 14 is a diagram illustrating an example of the flow of the process performed by the temporal direction control unit 112 according to this embodiment.

As shown in FIG. 14, the temporal direction control unit 112 first calculates an inter-frame difference of the gain (S202). When the inter-frame difference is calculated, the value of the gain temporarily stored in the frame memory is used.

Next, the temporal direction control unit 112 multiplies the response control value selected by the control value selection unit 110 by the calculated inter-frame difference of the gain (S204).

Next, the temporal direction control unit 112 performs the temporal direction response control of the gain by adding the value calculated in step S204 and the value of the gain input to the temporal direction control unit 112 (S206).

The temporal direction control unit 112 adjusts the speed of the temporal direction response control of the gain according to the value of the input response control value. Further, the response control value is calculated based on the inter-frame difference in the one-screen current average value between the frames.

When the inter-frame difference in the average current value is large, the temporal direction control unit 112 causes the gain to respond at high speed in terms of the protection of the light-emitting element of the display unit 118 or the power source. On the other hand, when the inter-frame difference in the average current value is small, the temporal direction control unit 112 causes the gain to respond at low speed to prevent image quality from deteriorating.

When the temporal direction control unit 112 performs the temporal direction response control of the gain, the temporal direction control unit 112 outputs the controlled gain to the gain control unit 114 and ends the series of processes (S206).

The process performed by the temporal direction control unit 112 has been described with reference to FIG. 14.

2-4-3. Flow of Process Performed by Control Value Selection Unit 110 (FIG. 15)

Next, the flow of a process performed by the control value selection unit 110 will be described with reference to FIG. 15. FIG. 15 is a diagram illustrating an example of the flow of the process performed by the control value selection unit 110 according to this embodiment.

As in FIG. 15, when the inter-frame difference D in the one-screen current average value is input (S302), the control value selection unit 110 determines whether the inter-frame difference D in the one-screen current average value is greater than the threshold value TH (S304).

When the inter-frame difference D in the one-screen current average value is greater than the threshold value TH, the control value selection unit 110 selects the value $K_1$ as the response control value $V_{C1}$ (S306). Further, the value $K_1$ is a response control value used to cause the temporal direction control unit 112 to perform the response control at high speed and is set to, for example, about 0.

Conversely, when the inter-frame difference D in the one-screen current average value is equal to or less than the threshold value TH, the control value selection unit 110 selects the value $K_2$ as the response control value $V_{C1}$ (S308). Further, the value $K_2$ is a response control value used to cause the temporal direction control unit 112 to perform the response control at low speed and is set to, for example, about 0.9.

The control value selection unit 110 outputs the selected response control value $V_{C1}$ to the temporal direction control unit 112 and ends the series of processes (S310).

The flow of the process performed by the control value selection unit 110 has been described with reference to FIG. 15.

2-5. Advantages of Temporal Direction Control (FIG. 16)

Next, the advantages of this embodiment will be described with reference to FIGS. 5 and 16. FIG. 5 is the diagram illustrating the gain change caused due to the appearance or disappearance of a telop. FIG. 16 is a diagram illustrating the advantages of this embodiment. The horizontal axis of FIG. 16 represents a one-screen current average value I. The vertical axis of FIG. 16 represents a gain $G_{OUT}$ obtained after the temporal direction control.

When the temporal direction response control is not performed, the gain is caused to respond to a change in the one-screen current average value of an input video signal at high speed. According to this embodiment, however, the gain can be caused to respond to a change in the one-screen current average value of an input video signal at high speed or at low speed.

Hereinafter, the ABL control performed when the luminance of only a part of an input video signal is changed due to, for example, appearance or disappearance of a telop will be described by comparing a case in which the temporal direction response control is not performed to a case in which the temporal direction response control is performed in this embodiment.

As described above with reference to FIG. 5, in the ABL control in which the temporal direction response control is not performed, the gain has considerably been changed even with the change in the one-screen current average value I caused due to the change in the luminance of only a part of a video signal such as appearance or disappearance of a telop.

On the other hand, in the ABL control of this embodiment in which the temporal direction response control is performed, as in FIG. 16, the value of the calculated gain $G_{OUT}$ is maintained even when the one-screen current average value I is changed only by ΔI due to the appearance or disappearance of the telop. That is, according to this embodiment, it is possible to obtain the advantage of calculating the gain $G_{OUT}$ while moving a graph of a function $G_{OUT}$=TH/I and a graph of a function $G_{OUT}$=translated in parallel only by ΔI from the graph.

This is the same when the ABL does not operate. That is, this means that the current value of a video signal output to the display unit 118 is changed with the change in the current value of the video signal input to the ABL control unit 100.

At this time, the change amount of the current value of the video signal output to the display unit 118 is the same as the change amount ΔI of the one-screen current average value I of the input video signal caused due to the appearance or disappearance of a telop.

Further, by predicting and setting the change amount of the threshold value which is a boundary (ABL point) of the one-screen current average value I for which the ABL control is performed beforehand, it is possible to prevent an overcurrent from flowing in the light-emitting element of the display unit 118 and also realize a high image quality of the display unit 118.

In a large-sized display device, particularly, humans can easily perceive deterioration in image quality caused due to a temporal-direction sharp change in the luminance of moving image contents continuous in the temporal direction in the ABL control. For this reason, in the case of a large-sized display device, the advantages obtained by applying the technology of this embodiment are particularly effective.

The advantages of this embodiment have been described with reference to FIG. 16.

3. Modification Examples

Although the basic configuration of the ABL control unit 100 according to this embodiment has been described, the application scope of the technology according to the embodiment is not limited thereto. For example, modification examples to be exemplified below are, of course, included in the application scope of the technology according to the embodiment.

3-1. First Modification Example

Calculation of Response Control Value by Signal Conversion: FIG. 17

Next, a first modification example of the embodiment will be described below with reference to FIG. 17. An ABL control unit according to the first modification example has a configuration in which the control value selection unit 110 included in the basic configuration of the above-described ABL control unit 110 is substituted with a signal conversion unit 111 to be described below. Further, since the constituent units of the ABL control unit 100 other than the signal conversion unit 111 are the same as the above-described basic configuration, the description thereof will not be repeated.

FIG. 17 is a diagram for describing the first modification example of the technology of the embodiment. As shown in FIG. 17, the inter-frame difference D in the one-screen current average value calculated by the inter-frame difference calculation unit 108 is input to the signal conversion unit 111.

The signal conversion unit 111 converts the inter-frame difference D in the one-screen current average value into a response control value $V_{C2}$. A conversion method performed by the signal conversion unit 111 may be a conversion method of converting the inter-frame difference D in the one-screen current average value of a small value between the frames into the response control value $V_{C2}$ used to perform the response control of slowing a response of the gain.

For example, when the minimum value $D_{MIN}$ of the value of the inter-frame difference D in the one-screen current average value is input, the signal conversion unit 111 outputs 1 as the response control value $V_{C2}$. Further, when the maximum value $D_{MAX}$ of the inter-frame difference D in the one-screen current average value is input, the signal conversion unit 111 outputs 0 as the response control value $V_{C2}$.

When a value other than the minimum value $D_{MIN}$ and the maximum value $D_{MAX}$ is input as the inter-frame difference D in the one-screen current average value, the signal conversion unit 111 performs linear conversion on the input value of the inter-frame difference D in the one-screen current average value and outputs a value between 0 and 1.

The above-described response control value $V_{C2}$ output by the signal conversion unit 111 is not limited to a binary value of 0 or 1. Therefore, the response control of the gain corresponding to the inter-frame difference D in the one-screen current average value can be performed more appropriately.

3-2. Second Modification Example

Selection of Response Control Value Based on Two Threshold Values: FIG. 18

Next, a second modification example of the embodiment will be described below with reference to FIG. 18. This modification example relates to a configuration in which a response control value is selected based on two threshold values. In this modification example, the response control of the gain can be performed in consideration of not only a case in which the luminance of a video signal input to the ABL control unit 100 increases but also a case in which the luminance of the video signal decreases.

The ABL control unit according to this modification example has a configuration in which the inter-frame difference calculation unit 108 included in the basic configuration of the above-described ABL control unit 100 is substituted with an inter-frame difference calculation unit 208 and the control value selection unit 110 is substituted with a control value selection unit 210.

FIG. 18 is a diagram for describing this modification example. First, the inter-frame difference calculation unit 208 will be described.

As shown in FIG. 18, the inter-frame difference calculation unit 208 stores a one-screen current average value I in a frame memory FM2. At a moment at which the one-screen current average value I of a given frame is input to the inter-frame difference calculation unit 208, the frame memory FM2 stores the one-screen current average value I of a frame input to the inter-frame difference calculation unit 208 immediately before the given frame.

An addition unit 222 of the inter-frame difference calculation unit 208 adds a value obtained by inverting the sign of the one-screen current average value I input at a given moment and the value stored in the frame memory FM2. The addition unit 222 outputs a calculated value $D_1$ to a determination unit 232 of a control value selection unit 210.

Here, when the luminance of a video input to the ABL control unit 100 decreases (in other words, when the frame is switched from a bright frame to a dark frame), the sign of the output value $D_1$ of the addition unit 222 become positive.

Further, an addition unit 224 of the hater-frame difference calculation unit 208 adds the one-screen current average value I input at a given moment and a value obtained by inverting the value stored in the frame memory FM2. The addition unit 224 outputs a calculated value $D_2$ to determination units 236 and 240 of the control value selection unit 210.

Here, when the luminance of a video input to the ABL control unit 100 increases (in other words, when the frame is switched from a dark frame to a bright frame), the sign of the output value $D_2$ of the addition unit 224 becomes positive.

The output value $D_1$ of the addition unit 222 and the output value $D_2$ of the addition unit 224 are values which have the same absolute value and opposite signs.

The process performed by the inter-frame difference calculation unit 208 has been described.

Next, a process performed by the control value selection unit 210 will be described. A determination unit 232 of the control value selection unit 210 determines whether the input value $D_1$ is greater than a preset threshold value $TH_1$.

When the input value $D_1$ is greater the threshold value $TH_1$, the determination unit 232 outputs 1 (true) to a selector 234, Conversely, when the input value $D_1$ is equal to or less than the threshold value $TH_1$, the determination unit 232 outputs 0 (false) to the selector 234.

The selector 234 selects one of values $K_{D1}$ and $K_{D2}$ as a response control value $V_{C3D}$. The value $K_{D1}$ is a response control value used to cause the temporal direction control unit 112 to perform the response control at high speed and is set to, for example, about 0. Further, the value $K_{D2}$ is a response control value used to cause the temporal direction control unit 112 to perform the response control at low speed and is set to, for example, about 0.9.

When 1 is input from the determination unit 232, the selector 234 selects the value $K_{D1}$ used for the response control of the high speed as the response control value $V_{C3D}$ and outputs the response control value $V_{C3D}$ to a selector 242. On the other hand, when 0 is input from the determination unit 232, the selector 234 selects the value $K_{D2}$ used for the response control of the low speed as the response control value $V_{C3D}$ and outputs the response control value $V_{C3D}$ to a selector 242.

A determination unit 236 determines whether the input value $D_2$ is greater than a preset threshold value $TH_2$.

When the input value $D_2$ is greater than the threshold value TH2, the determination unit 236 outputs 1 (true) to a selector 238. Conversely, when the input value $D_2$ is equal to or less than the threshold value TH2, the determination unit 236 outputs 0 (false) to the selector 238.

The selector 238 selects one of values $K_{U1}$ and $K_{U2}$ as a response control value $V_{C3U}$. The value $K_{U1}$ is a response control value used to cause the temporal direction control unit 112 to perform the response control at high speed and is set to, for example, about 0. Further, the value $K_{U2}$ is a response control value used to cause the temporal direction control unit 112 to perform the response control at low speed and is set to, for example, about 0.9.

When 1 is input from the determination unit 236, the selector 238 selects the value $K_{D1}$ used for the response control of the high speed as the response control value $V_{C3D}$ and outputs the response control value $V_{C3D}$ to the selector 242. On the other hand, when 0 is input from the determination unit 236, the selector 236 selects the value $K_{D2}$ used for the response control of the low speed as the response control value $V_{C3D}$ and outputs the response control value $V_{C3D}$ to the selector 242.

A determination unit 240 determines whether the input value $D_2$ is positive. When a video signal input to the ABL control unit 100 is changed from a dark frame to a bright frame, the value $D_2$ becomes positive. In this case, the determination unit 240 outputs 1 (true) to the selector 242.

On the other hand, when the video signal input to the ABL control unit 100 is changed from a bright frame to a dark frame, the value $D_2$ becomes negative. In this case, the determination unit 240 outputs 0 (false) to the selector 242.

As described above, the response control value $V_{C3D}$ selected based on the value $D_1$ between the inter-frame differences and the response control value $V_{C3U}$ selected based on the value $D_2$ are input to the selector 242. The selector 242 selects one of the two response control values $V_{C3D}$ and $V_{C3U}$ based on the binary value of 1 or 0 input from the determination unit 240.

The value $D_1$ becomes positive when the frame is switched from the bright frame to the dark frame. Further, the value $D_2$ becomes positive when the frame is switched from the dark frame to the bright frame.

The selector 242 selects the response control value $V_{C3D}$ selected based on the value $D_1$ when the frame is switched from the bright frame to the dark frame. That is, the selector 242 selects the response control value $V_{C3D}$ when 0 is input from the determination unit 240.

The selector 242 selects the response control value $V_{C3U}$ selected based on the value $D_2$ when the frame is switched from the dark frame to the bright frame. That is, the selector 242 selects the response control value $V_{C3U}$ when I is input from the determination unit 240.

The selector 242 outputs the selected response control value $V_{C3}$ to the temporal direction control unit 112.

The second modification example of the embodiment has been described with reference to FIG. 18. According to this modification example, as described above, the temporal direction response control of the gain can be performed not only when the video signal input to the ABL control unit 100 is changed from the dark frame to the bright frame but also when the video signal is changed from the bright frame to the dark frame.

Of course, the threshold value TH1 of the determination unit 232 and the threshold value TH2 of the determination unit 236 may be set to other values. Hereinafter, an example in which the threshold value TH1 is set to a value greater than the threshold value TH2 will be described.

On the assumption that the threshold value TH1 is set to a large value, there is a high possibility of the determination unit 232 outputting 0 (false) when the video signal input to the ABL control unit 100 is changed from the bright frame to the dark frame, hi this case, there is a high possibility of the selector 234 selecting the response control value $K_{D2}$ used to cause the gain to respond at low speed.

Conversely, on the assumption that the threshold value TH2 is set to a small value, there is a high possibility of the determination unit 236 outputting 1 (true) when the video signal input to the ABL control unit 100 is changed from the dark frame to the bright frame. In this case, there is a high possibility of the selector 238 selecting the response control value $K_{U1}$ used to cause the gain to respond at high speed.

According to this modification example, when the frame is switched from the dark frame to the bright frame, it is possible to cause the gain to respond to the change in the input video signal at high speed by prioritizing prevention of an overcurrent in the light-emitting element of the display unit 118 or the power source. On the other hand, when the frame is switched from the bright frame to the dark frame, it is possible to cause the gain to respond to the change in the input video signal at low speed by prioritizing an image quality since there is a low necessity to protect the display unit 118.

Thus, according to this modification example, it is possible to achieve both of high image quality and the prevention of an overcurrent.

3-3. Third Modification Example

Use of Telop Presence and Absence Information FIG. 19

Next, a third modification example of the embodiment will be described below with reference to FIG. 19. An ABL control unit 300 according to the third modification example has a configuration in which the inter-frame difference calculation unit 108 included in the basic configuration of the above-described ABL control unit 100 is deleted and a telop appearance or disappearance determination unit 308 to be described below is added. FIG. 19 is a diagram for describing this modification example.

A linear conversion unit 102 outputs a video signal obtained after linear conversion not only to a one-screen current average value calculation unit 104 but also to the telop appearance and disappearance determination unit 308. The telop appearance and disappearance determination unit 308 determines whether a telop is included in each frame of the video signal input to the ABL control unit 300. The telop appearance and disappearance determination unit 308 determines the appearance or disappearance of the telop of the input signal, for example, by performing a process of detecting an edge of the input video signal and detecting a character included in the telop using the edge detection result.

A method of detecting a telop is disclosed in, for example, Japanese Unexamined Patent Application Publication No. 2009-038671.

The telop appearance and disappearance determination unit 308 outputs 0 to a control value selection unit 110 when detecting the appearance or disappearance of the telop. The telop appearance and disappearance determination unit 308 outputs 1 to the control value selection 110 when not detecting the appearance or disappearance of the telop.

When the telop appearance and disappearance determination unit 308 is combined, the determination unit 132 of the control value selection unit 110 is deleted and the value input from the telop appearance and disappearance determination unit 308 is input directly to a selector 134 of the control value selection unit 110.

When the appearance or disappearance of the telop is detected, 0 is input to the selector 134. In this case, the selector 134 selects a value $K_2$ used to perform control of causing the gain to respond at low speed as a response control value $V_C$. Further, when the appearance or disappearance of the telop is not detected, 1 is input to the selector 134. In this case, the selector 134 selects a value $K_1$ used to perform control of causing the gain to respond at high speed as the response control value $V_C$.

According to this modification example, the appearance or disappearance of the telop is directly determined before the control of the response speed of the gain. Therefore, the control of the response speed of the gain for the appearance or disappearance of the telop can be performed more appropriately.

The third modification example of the embodiment has been described with reference to FIG. 19.

3-4. Fourth Modification Example

Use of Codec Information: FIG. 20

Next, a fourth modification example of the embodiment will be described below with reference to FIG. 20. An ABL control unit 400 according to the fourth modification example has a configuration in which the inter-frame difference calculation unit 108 included in the basic configuration of the above-described ABL control unit 100 is deleted and a codec information acquisition unit 408 to be described below is added. FIG. 20 is a diagram for describing this modification example.

The codec information acquisition unit 408 acquires codec information of each frame of a video signal input to the ABL control unit 300. In general, a video signal input to a display device is input in an encoded state. Therefore, the display device includes a codec that encodes and decodes a signal.

The codec information acquisition unit 408 acquires codec information obtained through encoding from a codec that is included in the display device 10 and decodes an input video signal. For example, the codec information includes information regarding an inter-frame difference or information regarding an object motion vector included in an input video.

For example, the information regarding the inter-frame difference included in the codec information is processed by the control value selection unit 110, as in the output value of the inter-frame difference calculation unit 108 in the basic configuration of the ABL control unit 100.

It can be understood that an object included in a given frame is not included in the subsequent frame from the information regarding the object motion vector included in the code information. Therefore, the object motion vector included in the codec information can be used to detect a change in a video signal.

For example, when the object motion vector is small, a change in luminance can easily be perceived by humans. Therefore, 0 may be output to the control value selection unit 110 to prioritize an image quality and cause the gain to respond at low speed.

On the other hand, when the object motion vector is large, 1 may be output to the control value selection unit 110 to prioritize the protection of the light-emitting element of the display unit 118 and cause the gain to respond at high speed.

When the codec information acquisition unit 408 is combined, the determination unit 132 of the control value selection unit 110 is deleted, and the value input from the codec information acquisition unit 408 is input directly to the selector 134 of the control value selection unit 110.

When 0 is input to the selector 134, the selector 134 selects the value $K_2$ used to perform control of causing the gain to respond at low speed as the response control value $V_C$. Further, when 1 is input to the selector 134, the selector 134 selects the value $K_1$ used to perform control of causing the gain to respond at high speed as the response control value $V_C$.

According to this modification example, it is possible to effectively use the code information used to encode and decode a video signal and control the response speed of the gain with respect to the change of the input video signal.

The fourth modification example of the embodiment has been described with reference to FIG. 20.

4. Summarization

Finally, the technical spirit and essence of the embodiment will be described in brief. The technical spirit and essence to be described below can be applied to, for example, a self-luminous type display device and a cellular phone, a game device, an information terminal, a personal computer, or the like having the same display function as the display device.

For example, in a display device to be described below in (1), when an input video signal sharply increases, a gain used to control the video signal responds to the input video signal at high speed. As a result, an overcurrent is prevented from flowing in a light-emitting element or a power source. On the other hand, when the input video signal gently increases, a gain used to control the video signal responds to the input video signal at low speed. As a result, the luminance of a screen of the display device is stabilized and image quality is prevented from deteriorating.

(1) A Display Device Including:

a temporal direction control unit that causes a gain used to control a video signal to respond to an input video signal at high speed when the input video signal sharply increases, and causes the gain to respond to the input video signal at low speed when the input video signal gently increases.

(2) The Display Device According to (1), Further Including:

a control value selection unit that selects a response control value used to adjust the speed at which the gain is caused to respond to the input video signal based on a difference in a current value between frames, wherein, based on the response control value, the temporal direction control unit adjusts the speed at which the gain is caused to respond to the input video signal.

(3) The Display Device According to (1), Further Including:

a control value selection unit that selects a high-speed response control value used to cause the gain to respond to the input video signal at the high speed when a telop appears or disappears, and selects a low-speed response control value used to cause the gain to respond to the input video signal at the low speed when the telop does not appear or disappear, wherein, based on the response control value, the temporal direction control unit adjusts the speed at which the gain is caused to respond to the input video signal.

(4) The Display Device According to (1), Further Including:

a control value selection unit that selects a response control value used to adjust the speed at which the gain is caused to respond to the input video signal based on codec information, wherein, based on the response control value, the temporal direction control unit adjusts the speed at which the gain is caused to respond to the input video signal.

(5) The display device according to (2), wherein the control value selection unit selects a high-speed control value used to cause the gain to respond to the input video signal at the high speed when an increase amount of the current value between the frames is greater than a predetermined threshold value, and selects a low-speed control value used to cause the gain to respond to the input video signal at the low speed when the increase amount of the current value between the frames is less than the predetermined threshold value.

(6) The Display Device According to (2), Further Including:

a signal conversion unit that converts the increase amount of the current value between the frames into the response control value which is a continuous value used to adjust the speed at which the gain is caused to respond to the input video signal, wherein, based on the response control value, the temporal direction control unit adjusts the speed at which the gain is caused to respond to the input video signal.

(7) The Display Device According to (2), wherein the control value selection unit selects a first high-speed response control value as the response control value used to cause the gain to respond to the input video signal at the high speed when the current value between the frames decreases and a decrease amount of the current value is greater than a first threshold value, wherein the control value selection unit selects a first low-speed response control value as the response control value used to cause the gain to respond to the input video signal at the low speed when the current value between the frames decreases and the decrease amount of the current value is less than the first threshold value, wherein the control value selection unit selects a second high-speed response control value as the response control value used to cause the gain to respond to the input video signal at the high speed when the current value between the frames increases and the increase amount of the current value is greater than a second threshold value, and wherein the control value selection unit selects a second low-speed response control value as the response control value used to cause the gain to respond to the input video signal at the low speed when the current value between the frames increases and the increase amount of the current value is less than the second threshold value.

(8) The Display Device According to Any One of (1) to (7), Further Including:

a display unit that includes a self-luminous type light-emitting element; and a display control unit that controls display of the display unit in accordance with the input video signal subjected to gain adjustment.

(9) An Integrated Circuit Having a Temporal Direction Control Function of Causing a gain used to control a video signal to respond to an input video signal at high speed when the input video signal sharply increases, and causes the gain to respond to the input video signal at low speed when the input video signal gently increases.

(10) A Control Method Including:

causing a gain used to control a video signal to respond to an input video signal at high speed when the input video signal sharply increases, and causes the gain to respond to the input video signal at low speed when the input video signal gently increases.

It should be understood by those skilled in the art that various modifications, combinations, sub-combinations and alterations may occur depending on design requirements and other factors insofar as they are within the scope of the appended claims or the equivalents thereof.

The present disclosure contains subject matter related to that disclosed in Japanese Priority Patent Application JP 2012-067034 filed in the Japan Patent Office on Mar. 23, 2012, the entire content of which is hereby incorporated by reference.

What is claimed is:

1. A display device comprising:

an average current value calculation unit configured to calculate an average current value for pixels included in an input signal;

a gain calculation unit configured to calculate a gain for controlling the input signal, the gain being based on the average current value;

a control value selection unit configured to determine prioritization based on a temporal change of the average current value; and a temporal direction control unit configured to cause the gain calculation unit to respond to the input signal at a first speed when preventing overcurrent is prioritized over maintaining image quality, and cause the gain calculation unit to respond to the input signal at a second speed when maintaining image quality is prioritized over preventing overcurrent, the first speed being higher than the second speed.

2. The display device according to claim 1, wherein the control value selection unit:

selects a response control value used to adjust the speed at which the gain is caused to respond to the input video signal based on a difference in a current value between frames, wherein, based on the response control value, the temporal direction control unit adjusts the speed at which the gain is caused to respond to the input video signal.

3. The display device according to claim 2, wherein the control value selection unit selects a first speed response control value used to cause the gain to respond to the input video signal at the first speed when an increased amount of the current value between the frames is greater than a predetermined threshold value, and selects a second speed response control value used to cause the gain to respond to the input video signal at the second speed when the increase amount of the current value between the frames is less than the predetermined threshold value.

4. The display device according to claim 2, further comprising:

a signal conversion unit that converts the increase amount of the current value between the frames into the response control value which is a continuous value used to adjust the speed at which the gain is caused to respond to the input video signal, wherein, based on the response value, the temporal direction control unit adjusts the speed at which the gain is caused to respond to the input video signal.

5. The display device according to claim 2, wherein the control value selection unit selects a first speed response control value as the response control value used to cause the gain to respond to the input video signal at the first speed when the current value between the frames decreases and a decrease amount of the current value is greater than a first threshold value, wherein the control value selection unit selects a second speed response control value as the response control value used to cause the gain to respond to the input video signal at the second speed when the current value between the frames decreases and the decrease amount of the current value is less than the first threshold value, wherein the control value selection unit select a third speed response control value as the response control value used to cause the gain to respond to the input video signal at a third speed when the current value between the frames increases and the increase amount of the current value is greater than a second threshold value, and wherein the control value selection unit selects a fourth speed response control value as the response control value used to cause the gain to respond to the input video signal at a fourth speed when the current value between the frames increases and the increase amount of the current value is less than the second threshold value.

6. The display device according to claim 1, wherein the control value selection unit:

selects a first speed response control value used to cause the gain to respond to the input video signal at the first speed when a telop does not appear or disappear, and selects a second speed response control value used to cause the gain to respond to the input video signal at the second speed when the telop appears or disappears, wherein, based on the response control value, the temporal direction control unit adjusts the speed at which the gain is caused to respond to the input video signal.

7. The display device according to claim 1, wherein the control value selection unit:

selects a response control value used to adjust the speed at which the gain is caused to respond to the input video signal based on codec information, wherein, based on the response control value, the temporal direction control unit adjusts the speed at which the gain is caused to respond to the input video signal.

8. The display device according to claim 1, further comprising:

a display unit that includes a self-luminous type light-emitting element; and a display control unit that controls display of the display unit in accordance with the input video signal subjected to gain adjustment.

9. An integrated circuit having, configured to:

calculate an average current value for pixels included in an input image signal;

calculate a gain for controlling the input signal, the gain being based on the average current value;

determine prioritization based on a temporal change of the average current value; and cause the gain to respond to the input signal at a first speed when preventing overcurrent is prioritized over maintaining image quality, and cause the gain to respond to the input signal at a second speed when maintaining image quality is prioritized over preventing overcurrent, the first speed being higher than the second speed.

10. A control method comprising:

calculating an average current value for pixels included in an input image signal;

calculating a gain for controlling the input signal, the gain being based on the average current value;

determining prioritization based on a temporal change of the average current value; and causing the gain to respond to the input signal at a first speed when preventing overcurrent is prioritized over maintaining image quality, and causing the gain to respond to the input signal at a second speed when maintaining image quality is prioritized over preventing overcurrent, the first speed being higher than the second speed.

* * * * *